US012311427B2

(12) United States Patent
Fujita et al.

(10) Patent No.: US 12,311,427 B2
(45) Date of Patent: May 27, 2025

(54) METHOD OF MANUFACTURING OVERLAPPED HOT STAMP MOLDED BODY, AND OVERLAPPED HOT STAMP MOLDED BODY

(71) Applicant: NIPPON STEEL CORPORATION, Tokyo (JP)

(72) Inventors: Soshi Fujita, Tokyo (JP); Yuki Suzuki, Tokyo (JP); Masahiro Fuda, Tokyo (JP); Hideaki Irikawa, Tokyo (JP); Jun Maki, Tokyo (JP); Nobuo Yoshikawa, Tokyo (JP); Naruhiko Nomura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 501 days.

(21) Appl. No.: 17/789,436

(22) PCT Filed: Feb. 24, 2021

(86) PCT No.: PCT/JP2021/006928
§ 371 (c)(1),
(2) Date: Jun. 27, 2022

(87) PCT Pub. No.: WO2021/172379
PCT Pub. Date: Sep. 2, 2021

(65) Prior Publication Data

US 2022/0402015 A1 Dec. 22, 2022

(30) Foreign Application Priority Data

Feb. 26, 2020 (JP) ..... 2020-030307

(51) Int. Cl.
*B21D 39/03* (2006.01)
*B21D 22/02* (2006.01)
(Continued)

(52) U.S. Cl.
CPC ..... *B21D 39/031* (2013.01); *B21D 22/022* (2013.01); *C22C 38/002* (2013.01);
(Continued)

(58) Field of Classification Search
CPC .. B21D 39/031; B21D 22/022; B21D 22/208; B21D 35/007; B21D 24/00;
(Continued)

(56) References Cited

U.S. PATENT DOCUMENTS

2012/0216920 A1 8/2012 Nam et al.
2014/0186655 A1 7/2014 Okita et al.
(Continued)

FOREIGN PATENT DOCUMENTS

EP 3 437 753 A1 2/2019
JP 2016-112569 A 6/2016
(Continued)

*Primary Examiner* — Brian D Walck
*Assistant Examiner* — Nazmun Nahar Shams
(74) *Attorney, Agent, or Firm* — Birch, Stewart, Kolasch & Birch, LLP

(57) ABSTRACT

A manufacturing method includes: heating an overlapped blank; transferring the heated overlapped blank; and a step of performing presswork on the heated overlapped blank by using a die. In the heating step, when sheet-thicknesses of the first and second steel sheets are set, respectively, and an average heating rate at a sheet temperature from 20 to 800° C. of a portion with a total sheet thickness of an overlapped portion, and a non-overlapped portion are set, the total sheet thickness is 2.5 to 5.0 mm, a maximum length of the overlapped portion is 100 to 1100 mm, an area of the first steel sheet, an area of a portion, of the second steel sheet, overlapped with the first steel sheet, and the average heating rates satisfy Expressions (1) to (3), and heating is performed at a temperature and for a time within a specific range on a plane of coordinates.

10 Claims, 6 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C23C 2/12*** | (2006.01) |

(52) U.S. Cl.
CPC ..... *C22C 38/02* (2013.01); *C22C 38/04* (2013.01); *C23C 2/12* (2013.01)

(58) Field of Classification Search
CPC ..... C22C 38/002; C22C 38/02; C22C 38/04; C22C 38/008; C22C 38/005; C22C 38/42; C22C 38/44; C22C 38/46; C22C 38/48; C22C 38/50; C22C 38/52; C22C 38/60; C22C 38/001; C22C 38/06; C22C 38/12; C22C 38/58; C23C 2/12; C23C 2/26; C23C 2/28; C21D 9/46; C21D 1/18; C21D 1/673; C21D 7/13; C21D 8/0278; C21D 2251/02
See application file for complete search history.

(56) References Cited

U.S. PATENT DOCUMENTS

| | | | |
|---|---|---|---|
| 2015/0167111 A1 | 6/2015 | Nam et al. | |
| 2018/0195144 A1 | 7/2018 | Morino et al. | |
| 2019/0105700 A1* | 4/2019 | Jimbo | C22C 38/002 |
| 2021/0197525 A1 | 7/2021 | Fujita et al. | |

FOREIGN PATENT DOCUMENTS

| | | |
|---|---|---|
| JP | 2016-124029 A | 7/2016 |
| KR | 10-1033767 B1 | 5/2011 |
| WO | WO 02/103073 A2 | 12/2002 |
| WO | WO 2008/053273 A1 | 5/2008 |
| WO | WO 2013/031984 A1 | 3/2013 |
| WO | WO 2019/194308 A1 | 10/2019 |

* cited by examiner

METHOD OF MANUFACTURING OVERLAPPED HOT STAMP MOLDED BODY, AND OVERLAPPED HOT STAMP MOLDED BODY

TECHNICAL FIELD

The present invention relates to a method of manufacturing an overlapped hot stamp molded body, and an overlapped hot stamp molded body.

BACKGROUND ART

In recent years, a steel sheet achieving both high strength and high moldability is demanded in a use of a steel sheet for an automobile. As one of steel sheets achieving both high strength and high moldability, there is a TRIP (Transformation Induced Plasticity) steel using martensite transformation of retained austenite. By using this TRIP steel, it is possible to manufacture a high-strength steel sheet excellent in moldability and having a strength of about 1000 MPa class. However, it is difficult to ensure the moldability in ultrahigh-strength steel having higher strength (for example, 1500 MPa or more) using the technique of the TRIP steel. Besides, there is a problem of poor shape fixability after molding and inferiority in dimensional accuracy of a molded product.

In contrast to the construction method of performing molding at a temperature near the room temperature (so-called cold press construction method) as described above, a construction method recently attracting attention is hot stamping (also called hot press, hot pressing, die-quenching, press quenching, and so on). This hot stamping is a method of manufacturing a part to obtain a material quality of a desired high strength after pressing by heating a steel sheet up to an Ac3 point or higher (for example, 800° C. or higher) to make it into austenite, immediately thereafter transferring the heated steel sheet to a pressing machine by using a robot or the like, for example, and pressing the heated steel sheet in a hot state to thereby ensure the moldability, and rapidly cooling it down to an Ms point or lower (for example, 400° C. or lower) by a die during keeping it at a bottom dead center to make the material into martensite to thereby quench it. By this construction method, an automobile part excellent also in shape fixability after molding can be obtained.

On the other hand, various press-molded bodies used for parts constituting the vehicle body of the automobile are required to be improved in a wide variety of performances and characteristics from various viewpoints such as static strength, dynamic strength, collision safety, and weight saving. For example, an automobile part such as A-pillar reinforce, B-pillar reinforce, bumper reinforce, tunnel reinforce, side sill reinforce, roof reinforce, or floor cross member is required to have collision resistant property only at a specific site of each automobile part more than a general site except the specific site.

Accordingly, a construction method of overlapping and bonding (spot-welding, for example) a plurality of steel sheets only at a portion corresponding to the specific site requiring reinforcement of the automobile part and then hot stamp molding the obtained steel sheet to manufacture an overlapped hot stamp molded body is actually employed from about 2007. This construction method is also called patch work. According to this construction method, it is possible to reinforce only the specific site of the hot stamp molded body by overlapping the steel sheets, while reducing the number of press dies, and further, it is possible to contribute also to a reduction in weight of the part because the part thickness is not unnecessarily increased. Note that the blank produced by overlapping and welding them as explained above is called an overlapped blank (also called a patch work blank).

A schematic view of a process of manufacturing an overlapped hot stamp molded body will be illustrated in FIG. 1. Although details will be described later, in FIG. 1, a reference numeral 4 denotes an overlapped blank, and a reference numeral 12 denotes an overlapped hot stamp molded body.

In a case where the steel sheets to be overlapped (denoted by a reference numeral 1 and a reference numeral 2 in FIG. 1) are non-plated steel sheets, oxide scale is generated on a surface of an overlapped hot-pressed member to be manufactured due to high-temperature heating accompanying hot press molding. Therefore, a problem is that there is a necessity of removing the generated oxide scale, for example, by shot blast processing after the hot press molding or that the corrosion resistance of the manufactured overlapped hot-pressed member is likely to decrease.

Further, the following is a problem peculiar to the case of using the non-plated steel sheet as the raw material of the overlapped blank. Specifically, a non-overlapped portion (hereinafter, also called "one-sheet part") can be subjected to shot blast processing and thus the oxide scale can be removed, resulting in that the decrease in corrosion resistance can be suppressed. On the other hand, removal of the oxide scale formed between steel sheets at an overlapped portion (hereinafter also called "overlapped part") by the shot blast processing is difficult, and particularly the corrosion resistance is likely to decrease, which is a problem.

If the steel sheets to be overlapped are plated steel sheets, the necessity of performing the shot blast processing on the overlapped hot-pressed member after the hot press molding is eliminated. General examples of the plated steel sheet used for hot pressing include a Zn-based plated steel sheet and an Al-based plated steel sheet. Regarding both of Zn-based plating and Al-based plating, the Zn-based plating becomes Zn—Fe-based plating and the Al-based plating becomes Al—Fe-based plating after the hot-stamping heating by an alloying reaction of diffusing Fe in the plating. A schematic view of a plated steel sheet will be illustrated in FIG. 2. Here, a reference numeral 13 denotes the plated steel sheet, a reference numeral 15 denotes a base material of the steel sheet, and a reference numeral 14 denotes a plated layer. This reference numeral 14 corresponds to the Zn-based plated layer or the Al-based plated layer.

Note that the aforementioned Zn-based plating means plating with a Zn content of 50 mass % or more, and the aforementioned Zn—Fe-based plating means plating with a total content of Zn and Fe of 50 mass % or more. Further, the Al-based plating means plating with an Al content of 50 mass % or more, and the aforementioned Al—Fe-based plating means plating with a total content of Al and Fe of 50 mass % or more.

As disclosed in Patent Document 1 and Patent Document 2, a Zn-based plated steel sheet (namely, a plated steel sheet containing 50 mass % or more of Zn (Zn plating or alloy plating of a Zn—Fe alloy, a Zn—Ni alloy, a Zn—Fe—Al alloy, or the like)) suppresses the generation of the oxide scale to eliminate the problem of the necessity of the shot blast processing. However, in the case of using the Zn-based plated steel sheet as a raw material of the overlapped blank and performing a bending molding on the overlapped part during the hot stamp molding, cracks occur in a base iron due to galvanization to cause a problem in collision resistant property in some cases. This is because when zinc being a metal relatively low in melting point remains, Zn becomes a liquid metal to intrude from the plating surface into the base iron. Such a phenomenon is called liquid metal embrittlement (LME). Note that the bending molding is a means for ensuring the collision resistant property in terms of a shape. Performing the bending molding on the overlapped part is a very important using method of the overlapped molded body.

As disclosed in Patent Document 1 and Patent Document 2, general examples of the measure for the liquid metal embrittlement employed in the case of using the Zn-based plated steel sheet for the hot stamping include a measure of increasing the melting point of the plating by promoting the Zn—Fe alloying reaction during the hot-stamping heating, and a measure of waiting for solidification of zinc by decreasing the molding temperature during the bending molding in the hot stamping. However, as problems peculiar to the case of using the zinc-based plated steel sheet as a raw material of the overlapped blank, there can be cited following three problems. Firstly, there is a problem that the overlapped part has a sheet thickness larger than that of the one-sheet part and therefore both of a temperature raising rate and a cooling rate are low, which makes it difficult to promote the Zn—Fe alloying reaction during the hot-stamping heating. Secondly, there is a problem that, regarding a molding temperature during the hot stamp molding, when waiting for the overlapped part to cool, the one-sheet part cools early, and thus the one-sheet part cannot ensure the martensite structure. Thirdly, Zn becomes a film of a zinc oxide to suppress the evaporation of Zn at the one-sheet part, but deficiency of oxygen occurs in an atmosphere between the steel sheets at the overlapped part and therefore Zn evaporates. Consequently, a decrease in corrosion resistance occurs due to the decrease in plating at the overlapped part, which is a problem.

An Al-based plated steel sheet as disclosed in Patent Document 3 and Patent Document 4 (namely, a plated steel sheet containing 50 mass % or more of Al (Al plating or alloy plating of an Al—Si alloy, an Al—Fe alloy, an Al—Fe—Si alloy, or the like)) suppresses the generation of the oxide scale, in a similar manner to Zn to eliminate the problem of the necessity of the shot blast processing. Besides, the Al-based plated steel sheet does not cause the problem of liquid metal embrittlement (LME), and the boiling point thereof is high to be 2470° C., so that it is suitable for use as a material of the overlapped blank.

PRIOR ART DOCUMENT

Patent Document

Patent Document 1: Japanese Laid-open Patent Publication No. 2016-112569

Patent Document 2: Japanese Laid-open Patent Publication No. 2016-124029

Patent Document 3: International Publication No. WO 2002-103073

Patent Document 4: International Publication No. WO 2008-053273

DISCLOSURE OF THE INVENTION

Problems to be Solved by the Invention

However, in the case of using the Al-based plated steel sheet as disclosed in Patent Document 3 and Patent Document 4 as a raw material of the overlapped blank, there arises a problem of a temperature raising rate of the overlapped part being low in heating during the hot stamping. Specifically, the temperature raising rate when heating the overlapped blank is low at the overlapped portion (overlapped part), and is high at the non-overlapped portion (one-sheet part). For this reason, in the middle of the raise in temperature, a difference in sheet temperature is generated between the overlapped part and the one-sheet part. Due to the difference in temperature, the one-sheet part having a high temperature extends more than the overlapped part, in accordance with the linear expansivity (Fe: $11.7\times10^{-6}$ [1/° C.]). As a result of this, as illustrated in FIG. 3, warpage of the steel sheet occurs in the middle of the raise in temperature, which is a problem. Note that when the heating is performed for a certain period of time, the temperature within the blank is equalized during a period in which the raise in temperature is terminated and then the blank is held at a high temperature, the warpage is gradually corrected, and is flattened in the end.

The warpage of the steel sheet in the middle of the raise in temperature causes problems regarding productivity in heating, as will be described next. Generally, heating furnaces used for the hot stamping include one of a type called a roller hearth furnace (also called a linear furnace) in which a steel sheet is placed on rolls which are continuously provided in a horizontal direction, and the steel sheet is heated while being moved between the rolls due to rotation of the rolls, and one of a type called a multistage furnace (also called a pizza furnace) in which a steel sheet is placed inside a heating furnace having a plurality of heating places in a horizontal direction and a vertical direction, and the steel sheet is heated without being moved. In the furnace of either type, the aforementioned warpage of the steel sheet hinders the productivity in heating. More concretely, in the roller hearth furnace, the occurrence of warpage may change a traveling direction when transferring the steel sheet by the rotation of the rolls, resulting in that the movement of the steel sheet in the furnace may be hindered or the steel sheet may drop off between the rolls. Further, in the multistage furnace, the occurrence of warpage may displace a position of the steel sheet before and after the heating, and besides, since a heating space is narrow in some cases, the steel sheet may be brought into contact with a furnace wall due to the warpage to damage the facility.

Note that in either of the roller hearth furnace and the multistage furnace, after carrying the heated blank out of the heating furnace, the heated blank has to be transferred to a pressing machine. Generally, the heated blank is grasped by a robot to be transferred to the pressing machine. However, when the warpage remains in the heating-completed blank, it becomes difficult to grasp the blank by the robot, and when large warpage occurs in the middle of the heating, a position of the blank moves, resulting in that, in the worst case, the production is stopped to cause a problem in the productivity regarding the transfer in the hot stamping.

In particular, in the heating at the temperature raising rate of 4 to 12° C./s as disclosed in Patent Document 4, the temperature raising rate is relatively high, so that the difference in temperature raising rate between the one-sheet part and the overlapped part is increased. As a result of this, the warpage of the steel sheet occurs more, which is a problem. The equalization regarding such a difference in temperature raising rate between the one-sheet part and the overlapped part is hindered also when the heating temperature is high, and the warpage occurs more significantly.

For this reason, in order to suppress the oxide scale of the base iron and to prevent the problem of liquid metal embrittlement as explained above, points as follows are desired regarding the aluminum-based plated steel sheet suitable for use as a raw material of the overlapped blank for hot stamping. Specifically, it is desired to solve the problem about the warpage of the steel sheet due to the difference in temperature raising rate between the overlapped part and the one-sheet part so as to improve the productivity during hot-stamping heating regarding the method of manufacturing the overlapped hot stamp molded body.

Accordingly, the present invention has been made in consideration of the above problems, and an object of the present invention is to solve the problem about warpage of a steel sheet due to a difference in temperature raising rate between an overlapped part and a one-sheet part when using an aluminum-based plated steel sheet as a raw material so as to provide a method of manufacturing an overlapped hot stamp molded body, and an overlapped hot stamp molded body which can further improve the productivity during hot-stamping heating.

Means for Solving the Problems

The present inventors repeatedly carried out intensive studies for solving the above problems, and found that it is important to suppress a difference in linear expansion between the overlapped portion (namely, the overlapped part) and the non-overlapped portion (namely, the one-sheet part). Concretely, a difference $\Delta L$ [mm] in linear expansion which exerts an influence on the warpage, is expressed by a product of a linear expansivity $\alpha$ [1/° C.] inherent in the material, a maximum length L [mm] of the overlapped part, and a temperature difference $\Delta T$ [° C.] between the overlapped part and the one-sheet part ($\Delta L=\alpha\times L\times\Delta T$). Accordingly, the present inventors found that it is possible to improve the warpage by suppressing a length of the overlapped part to 100 to 1100 mm, and suppressing a difference in an average heating rate between the overlapped part and the one-sheet part to 3.0° C./s or less.

Further, the heating gradually proceeds from the one-sheet part toward the overlapped part, and even in the one-sheet part, the heating gradually proceeds from an end toward a center within a blank face. Accordingly, the present inventors found that by slowly heating the overlapped part at the average heating rate in a range of 1.0 to 4.0° C./s, it is possible to improve the warpage by suppressing the unevenness of temperature of the overlapped part within the blank.

Besides, the present inventors also found that, regarding an overlapped part between a first steel sheet having an area S1 ($cm^2$) and a sheet thickness t1 (mm), and a second steel sheet having an area smaller than that of the first steel sheet and a sheet thickness t2 (mm), it is possible to suppress the warpage by increasing rigidity of the overlapped part. Specifically, they found that, when, out of an area of the second steel sheet, an area of a portion overlapped with the first steel sheet is set to S2 ($cm^2$), by setting a total sheet thickness (t1+t2) to 2.5 mm or more and 5.0 mm or less, with the aforementioned areas S1 and S2 and the aforementioned sheet thickness t1 satisfying a specific condition, the warpage in the middle of the raise in temperature can be improved.

Further, when a heated overlapped steel sheet is taken out of a heating furnace, it is required that a sheet temperature of the overlapped part and the one-sheet part is equalized by a furnace temperature and the warpage is corrected, in terms of stability when transferring the steel sheet. The present inventors found that the warpage of the overlapped steel sheet when carrying it out of the heating furnace can be improved by heating the overlapped steel sheet at a heating temperature and for a heating time positioned within a figure ABCD defined by a point A (4 minutes, 930° C.), a point B (10 minutes, 930° C.), a point C (20 minutes, 870° C.), and a point D (8 minutes, 870° C.), on a plane of coordinates defined by (heating time, temperature in preheated furnace).

Besides, the present inventors found that, when examining the corrosion resistance of an overlapped hot stamp molded body in the case of suppressing the warpage, in the first steel sheet at a portion overlapped with the second steel sheet, formation of red rust on a plated layer on a face not in contact with the second steel sheet is suppressed. It is estimated that this is because of an influence of suppression of crack in the plating, which is caused by a reduction in tensile stress formed in an Al—Fe-based plated layer, due to the improvement of warpage.

The gist of the present invention completed based on the above findings is as follows.

[1] A method of manufacturing an overlapped hot stamp molded body by using an overlapped blank obtained by overlapping and bonding a first steel sheet having an area S1 ($cm^2$) and at least one second steel sheet having an area smaller than that of the first steel sheet, in which each of the first steel sheet and the second steel sheet is an Al-based plated steel sheet having an Al-based plated layer on a base material, the method of manufacturing an overlapped hot stamp molded body including: an overlapped blank heating step of heating the overlapped blank in a heating furnace; a heated blank transferring step of carrying the heated overlapped blank out of the heating furnace and transferring it to a pressing apparatus; and a hot stamping step of performing presswork on the heated overlapped blank by using a die provided to the pressing apparatus, to obtain an overlapped hot stamp molded body, in which in the overlapped blank heating step, when a sheet thickness of the first steel sheet is set to t1 (mm), a sheet thickness of the second steel sheet is set to t2 (mm), an average heating rate at a sheet temperature from 20° C. to 800° C. of a portion with a total sheet thickness (t1+t2) at which the first steel sheet and the second steel sheet are overlapped is set to V (° C./s), and an average heating rate at a sheet temperature from 20° C. to 800° C. of a portion, of the first steel sheet, which is not overlapped with the second steel sheet is set to v1 (° C./s), the total sheet thickness (t1+t2) of the overlapped portion is 2.5 mm or more and 5.0 mm or less, a maximum length L of the overlapped portion of the second steel sheet is 100 mm or more and 1100 mm or less, the average heating rates V and v1 satisfy relational expressions of following Expression (1) and Expression (2), when, out of an area of the second steel sheet, an area of a portion overlapped with the first steel sheet is set to S2 ($cm^2$), the areas S1 and S2, and the sheet thickness t1 satisfy a relational expression of following Expression (3), and the overlapped blank is heated at a heating temperature and for a heating time positioned within a figure ABCD defined by a point A (4 minutes, 930° C.), a point B (10 minutes, 930° C.), a point C (20 minutes, 870° C.), and a point D (8 minutes, 870° C.) on a plane of coordinates defined by the heating time and the heating temperature.

[2] In the method of manufacturing an overlapped hot stamp molded body according to [1], the maximum length L of the overlapped portion of the second steel sheet is 300 mm or more.

[3] In the method of manufacturing an overlapped hot stamp molded body according to [1] or [2], the base material of the first steel sheet and the second steel sheet contains, by mass %, C: 0.10% or more and 0.50% or less, Si: 0.01% or more and 2.00% or less, Mn: 0.30% or more and 5.00% or less, P: 0.100% or less, S: 0.1000% or less, N: 0.0100% or less, Al: 0.500% or less, and B: 0.0002% or more and 0.0100% or less, with the balance made up of Fe and impurities.

[4] In the method of manufacturing an overlapped hot stamp molded body according to [3], the base material of the first steel sheet and the second steel sheet further contains, by mass %, as a substitute for a part of Fe being the balance, one or more kinds of W: 0% or more and 3.0% or less, Cr: 0% or more and 2.0% or less, Mo: 0% or more and 3.0% or less, V: 0% or more and 2.0% or less, Ti: 0% or more and 0.5% or less, Nb: 0% or more and 1.0% or less, Ni: 0% or more and 5.0% or less, Cu: 0% or more and 3.0% or less, Co: 0% or more and 3.0% or less, Sn: 0% or more and 0.10% or less, Sb: 0% or more and 0.10% or less, Mg: 0% or more and 0.0050% or less, Ca: 0% or more and 0.0050% or less, and O: 0% or more and 0.0070% or less.

[5] In the method of manufacturing an overlapped hot stamp molded body according to [3] or [4], a C content C1 (mass %) of the base material of the first steel sheet and a C content C2 (mass %) of the base material of the second steel sheet satisfy a relational expression of following Expression (4).

[6] An overlapped hot stamp molded body including: a first steel sheet having an area S1 ($cm^2$); and at least one second steel sheet having an area smaller than that of the first steel sheet, the first steel sheet and the second steel sheet being stacked on each other, in which an Al—Fe-based plated layer is provided on surfaces of the first steel sheet and the second steel sheet, the Al—Fe-based plated layer is formed of a compound layer of Al and Fe, and an Al solid-dissolved Fe layer, when a sheet thickness of the first steel sheet and a sheet thickness of the second steel sheet are set to t1 and t2 (mm), respectively, a total sheet thickness (t1+t2) of a portion at which the first steel sheet and the second steel sheet are overlapped is 2.5 mm or more and 5.0 mm or less, a maximum length L of the overlapped portion of the second steel sheet is 100 mm or more and 1100 mm or less, when, out of an area of the second steel sheet, an area of a portion overlapped with the first steel sheet is set to S2 ($cm^2$), the areas S1 and S2, and the sheet thickness t1 satisfy a relational expression of following Expression (3), in the Al—Fe-based plated layer of the portion at which the first steel sheet and the second steel sheet are overlapped, on a face at which the first steel sheet is not in contact with the second steel sheet, the number of cracks reaching the Al solid-dissolved Fe layer is 5 or less per length of 100 μm parallel to the Al—Fe-based plated layer, and a thickness D1 (μm) of the Al solid-dissolved Fe layer of a portion, of the first steel sheet, which is not overlapped with the second steel sheet and a thickness D2 (μm) of the Al solid-dissolved Fe layer of the second steel sheet satisfy a relational expression of following Expression (5).

[7] In the overlapped hot stamp molded body according to [6], the maximum length L of the overlapped portion of the second steel sheet is 300 mm or more.

[8] In the overlapped hot stamp molded body according to [6] or [7], the base material of the first steel sheet and the second steel sheet contains, by mass %, C: 0.10% or more and 0.50% or less, Si: 0.01% or more and 2.00% or less, Mn: 0.30% or more and 5.00% or less, P: 0.100% or less, S: 0.1000% or less, N: 0.0100% or less, Al: 0.500% or less, and B: 0.0002% or more and 0.0100% or less, with the balance made up of Fe and impurities.

[9] In the overlapped hot stamp molded body according to [8], the base material of the first steel sheet and the second steel sheet further contains, by mass %, as a substitute for a part of Fe being the balance, one or more kinds of W: 0% or more and 3.0% or less, Cr: 0% or more and 2.0% or less, Mo: 0% or more and 3.0% or less, V: 0% or more and 2.0% or less, Ti: 0% or more and 0.5% or less, Nb: 0% or more and 1.0% or less, Ni: 0% or more and 5.0% or less, Cu: 0% or more and 3.0% or less, Co: 0% or more and 3.0% or less, Sn: 0% or more and 0.10% or less, Sb: 0% or more and 0.10% or less, Mg: 0% or more and 0.0050% or less, Ca: 0% or more and 0.0050% or less, O: 0% or more and 0.0070% or less, and REM: 0% or more and 0.0070% or less.

[10] In the overlapped hot stamp molded body according to [8] or [9], a C content C1 (mass %) of the base material of the first steel sheet and a C content C2 (mass %) of the base material of the second steel sheet satisfy a relational expression of following Expression (4).

$$1.0 \leq V \leq 4.0 \quad \text{Expression (1)}$$

$$(v1 - V) \leq 3.0 \quad \text{Expression (2)}$$

$$400 \leq (S1 - S2) \times (t1/10) \leq 950 \quad \text{Expression (3)}$$

$$0.03 \leq (C2 - C1) \leq 0.30 \quad \text{Expression (4)}$$

$$(D1 - D2) \leq 6.0 \quad \text{Expression (5)}$$

Effect of the Invention

As described above, according to the present invention, when an Al-based plated steel sheet is used as a raw material, it is possible to improve the problem of warpage of the steel sheet during heating, in a process of manufacturing an overlapped hot stamp molded body.

EMBODIMENTS FOR CARRYING OUT THE INVENTION

Preferred embodiments of the present invention will be explained below in detail while referring to the accompanying drawings. Note that, in the present description and the drawings, the same codes are given to components having substantially the same functional configurations to omit duplicated explanation.

<<1. Outline of Method of Manufacturing Overlapped Hot Stamp Molded Body>>

Figure 1:
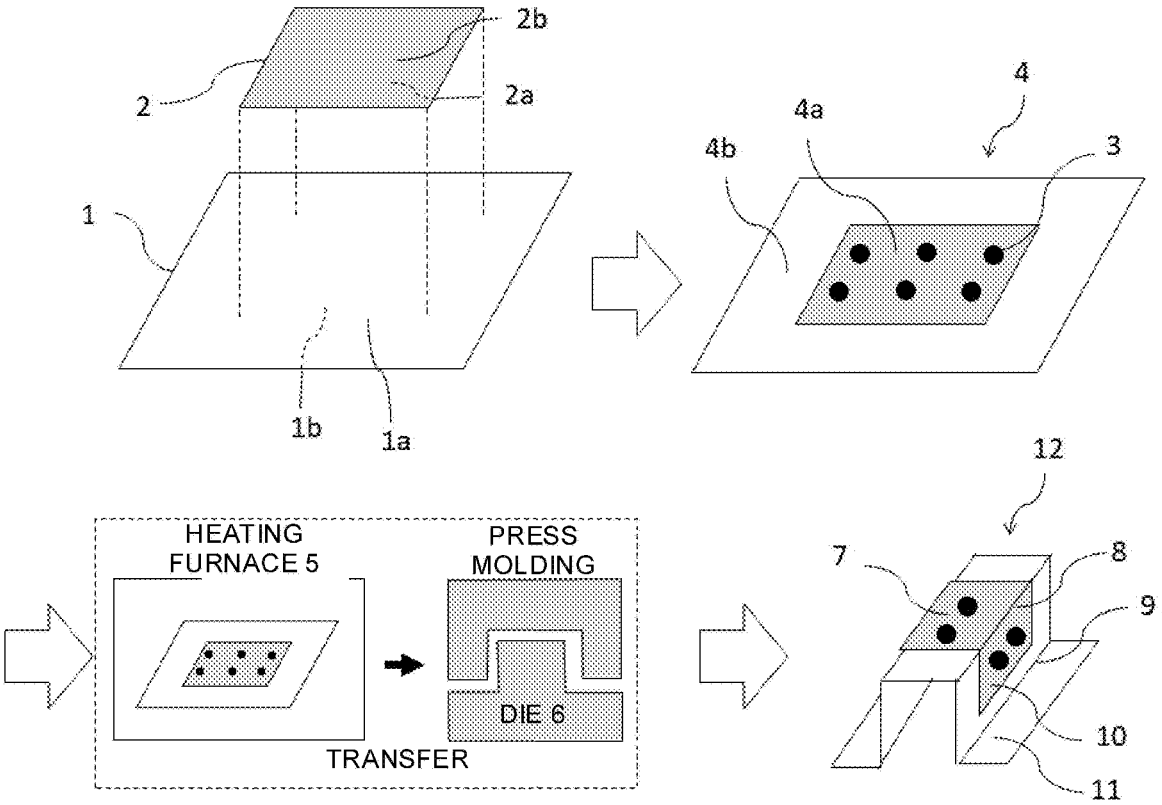
FIG. 1 is a view illustrating an outline of steps of manufacturing an overlapped hot stamp molded body.

FIG. 1 is a view schematically illustrating examples of a method of manufacturing an overlapped hot stamp molded body using an overlapped blank for hot stamping, and an overlapped hot stamp molded body. Hereinafter, explanation will be made based on FIG. 1 and FIG. 2.

The method of manufacturing an overlapped hot stamp molded body is used as a method of manufacturing an overlapped hot stamp molded body by using an overlapped blank for hot stamping as a raw material.

An overlapped blank for hot stamping 4 is composed of a first steel sheet 1 (reference numeral 1 in FIG. 1) and a second steel sheet 2 (reference numeral 2 in FIG. 1) having an area smaller than that of the first steel sheet by bonding (reference numeral 3 in FIG. 1) them. At this time, a portion of the overlapped blank for hot stamping 4 (reference numeral 4 in FIG. 1) at which the second steel sheet 2 is overlapped is called an overlapped part 4*a*, and a non-overlapped portion is called a one-sheet part 4*b*.

Figure 2:
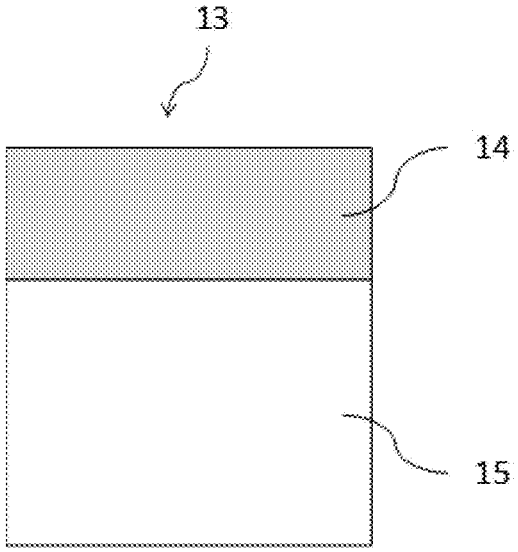
FIG. 2 is a view illustrating a cross section of a steel sheet covered with an Al-based plated layer.
Figure 3:
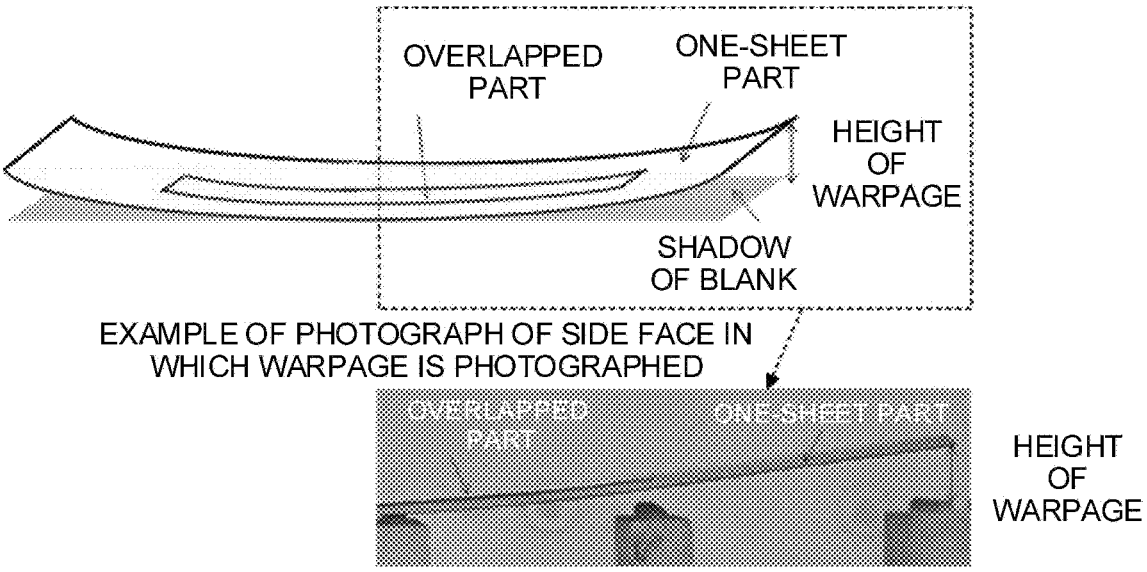
FIG. 3 is a view schematically illustrating a case where warpage occurs in the middle of the raise in temperature in a heating step of a blank, and showing an example of a photograph of a side face in which the warpage in the middle of the raise in temperature is actually photographed.

An outline of a method of manufacturing the overlapped blank for hot stamping 4 according to the embodiment of the present invention to be explained below in detail is also as illustrated in FIG. 1, and an outline of a configuration of the overlapped blank for hot stamping 4 is also as illustrated in FIG. 2.

Note that also in the overlapped blank for hot stamping 4 according to the embodiment of the present invention, the second steel sheet 2 is preferably arranged within the first steel sheet 1 so that a portion protruding from the first steel sheet 1 does not exist, as schematically illustrated in FIG. 1. However, it is also possible that a portion of the second steel sheet 2 protruding from the first steel sheet 1 exists.

Further, on the surface of the first steel sheet 1, both faces of a face 1*a* on the side in contact with the second steel sheet 2 and a face 1*b* on the side not in contact with the second steel sheet 2 are covered with an Al-based plated layer (reference numeral 14 in FIG. 2). Similarly, on the second steel sheet 2 as well, both faces of a face 2*a* on the side in contact with the first steel sheet 1 and a face 2*b* on the side not in contact with the first steel sheet 1 are covered with the Al-based plating.

The overlapped blank for hot stamping 4 is heated up to an Ac3 point or higher in a heating furnace 5, whereby a base material portion of the steel sheet is made into austenite. The heated steel sheet is transferred right after it is taken out of the furnace, and is press-molded and rapidly cooled by a die 6, whereby the steel sheet is transformed into martensite. Consequently, the overlapped blank for hot stamping 4 becomes a hot stamp molded body 12 excellent in collision resistant property.

In FIG. 1, a molded product obtained by using a hat-shaped die is illustrated as an example of the overlapped hot stamp molded body 12. In the present description, names of sites of the hot stamp molded body 12 are a head top part 7, a bent part 8 of the head top part, a vertical wall part 10, a flange part 11, and a bent part 9 of the flange part.

Note that although the second steel sheet 2 is arranged outside on the head top part 7 side in FIG. 1, the second steel sheet 2 may also be arranged inside the head top part 7.

<<2. Method of Manufacturing Overlapped Hot Stamp Molded Body>>

Hereinafter, a manufacturing method characteristic of the overlapped hot stamp molded body according to the embodiment of the present invention will be explained in detail.

(2-1. Overlapped Blank)

The overlapped blank for hot stamping (which is simply referred to as "blank" in some cases hereinafter) 4 according to the present embodiment includes a first steel sheet 1 having an area S1 ($cm^2$), and a second steel sheet 2 bonded to the first steel sheet 1 and having an area smaller than that of the first steel sheet 1, in a similar manner to the above-described overlapped blank for hot stamping 4 illustrated in FIG. 1 and FIG. 2. Further, both faces of each of the first steel sheet 1 and the second steel sheet 2 are covered with Al-based plating. Specifically, each of the first steel sheet 1 and the second steel sheet 2 according to the present embodiment is an Al-based plated steel sheet having an Al-based plated layer on both surfaces of the steel sheet to be a base material. Note that the area S1 of the first steel sheet 1 corresponds to an area of a flat surface (area per single surface) of the steel sheet which is substantially orthogonal to a sheet thickness direction of the first steel sheet 1.

<Base Material>

In the overlapped blank for hot stamping 4 according to the present embodiment, chemical components of the base material in each of the first steel sheet 1 and the second steel sheet 2 are not particularly limited. However, in order to obtain, for example, a tensile strength of 1000 MPa or more (about 300 HV or more in terms of Vickers hardness when a load is set to 9.81 N), it is preferable to use a base material having following chemical components. Further, the chemical components of the base material of the first steel sheet 1 and the chemical components of the base material of the second steel sheet 2 may be the same or different within the range of the following chemical components.

Specifically, the chemical components of the base material of the first steel sheet 1 and the second steel sheet 2 according to the present embodiment contain, by mass %, C: 0.10% or more and 0.50% or less, Si: 0.01% or more and 2.00% or less, Mn: 0.30% or more and 5.00% or less, P: 0.100% or less, S: 0.1000% or less, N: 0.0100% or less, Al: 0.500% or less, and B: 0.0002% or more and 0.0100% or less, with the balance made up of Fe and impurities. Further, it is preferable that the chemical components of the base material of the first steel sheet 1 and the second steel sheet 2 according to the present embodiment further contain, as a substitute for a part of Fe being the balance, one or more kinds of Ti: 0% or more and 0.5% or less, Nb: 0% or more and 1.0% or less, Cr: 0% or more and 2.0% or less, W, Mo: 0% or more and 3.0% or less, V: 0% or more and 2.0% or less, Ni: 0% or more and 5.0% or less, Cu, Co: 0% or more and 3.0% or less, Sn, Sb: 0% or more and 0.10% or less, Mg, Ca: 0% or more and 0.0050% or less, and O, REM: 0% or more and 0.0070% or less, in order to improve the collision resistant property of the steel sheet.

Further, as a steel sheet used for an automobile part, a steel sheet having a high C content and a high tensile strength is used for increasing collision safety. Accordingly, also in the steel sheet used for the overlapped hot stamp molded body, a steel sheet having a high C content has been commonly used for each of the first steel sheet and the second steel sheet. However, when a C content of the base material of the first steel sheet 1 is set to C1 (mass %), and a C content of the base material of the second steel sheet 2 is set to C2 (mass %), C1 and C2 preferably satisfy a relational expression of $0.03 \leq (C2-C1) \leq 0.30$. The increase in C content increases a deformation resistance of the steel sheet at a high temperature. For this reason, in order to suppress the warpage of the blank 4 during heating, it is preferable to increase the C content. From such a viewpoint, it is preferable that the C content is increased in the second steel sheet whose temperature is equalized, and the C content is reduced in the first steel sheet whose temperature is not equalized between the one-sheet part and the overlapped part. As a result of earnest studies conducted by the present inventors, it was clarified that it is possible to more surely suppress the warpage of the blank 4 by setting the difference between C2 and C1 (C2−C1) to 0.03 mass % or more. The difference between C2 and C1 (C2−C1) is preferably 0.04 mass % or more, and more preferably 0.05 mass % or more. On the other hand, by setting the difference between C2 and C1 (C2−C1) to 0.30 mass % or less, it becomes possible to more surely suppress the embrittlement of the base material of the second steel sheet and the extreme reduction in the tensile strength of the first steel sheet. As a result of this, it becomes possible to more surely secure the collision property of a part manufactured by using such a blank, to thereby secure the practicality of the part. The difference between C2 and C1 (C2−C1) is more preferably 0.28 mass % or less, and still more preferably 0.25 mass % or less.

A method of manufacturing the Al-based plated steel sheet using the base material having the above chemical composition is not particularly limited but, for example, the one manufactured through a conventional pig iron-making step and steel-making step and by steps of hot rolling, pickling, cold rolling, and Sendzimir hot-dip Al plating can be used.

<Regarding Al-Based Plated Layer>

In the present embodiment, a front surface and a rear surface of each of the first steel sheet 1 and the second steel sheet 2 are covered with the Al-based plated layer.

Examples of the characteristics required for the Al-based plated layer include suppression of the occurrence of Fe scale during hot-stamping heating and suppression of chip of plating due to peeling (also called powdering) of the plating during the hot stamp molding, and pressing flaw caused when the peeled plating adheres to another place. The powdering occurs due to a compressive stress applied on the plating on the face inside the bent part occurring during molding or due to a shear stress applied on the plating by the sliding from the die during molding. For this reason, a plating thickness of the Al-based plated layer is preferably 10 μm or more and 50 μm or less in each of the first steel sheet 1 and the second steel sheet 2 independently. When the plating thickness is less than 10 μm, there is a possibility that the effect of suppressing the occurrence of Fe scale becomes insufficient. By setting the plating thickness of the Al-based plated layer to 10 μm or more, the effect of suppressing the occurrence of Fe scale can be more surely exhibited. The plating thickness of the Al-based plated layer is more preferably 15 μm or more. On the other hand, when the plating thickness exceeds 50 μm, the powdering may occur frequently. By setting the plating thickness to 50 μm or less, it becomes possible to more surely prevent the occurrence of powdering. The plating thickness of the Al-based plated layer is more preferably 45 μm or less.

Note that as a method of specifying the plating thickness of the Al-based plated layer, an optical microscope is used to observe a cross section of plating without etching in a field of view of 100 μm×100 μm, and the plating thickness can be determined by measuring it. More specifically, the cross section of plating is observed through the above-described method at arbitrary plural locations (3 locations, for example), and the plating thickness at each observation location is specified. After that, an average value of the obtained plating thicknesses is calculated, and the obtained average value may be set to the plating thickness of the Al-based plated layer.

According to the general hot-dip plating method as the method of covering the base material with the Al-based plated layer, the steel sheet is dipped in a hot-dip aluminum plating bath and subjected to gas wiping in nitrogen, atmosphere, or the like, whereby the Al-based plated steel sheet (reference numeral 13 in FIG. 2) adjusted in deposition amount can be manufactured. At this time, the Al-based plated layer and Fe in the base material are subjected to an alloying reaction during the hot dipping, resulting in that an Al—Fe-based interface alloy layer of about several μm is inevitably formed at an interface between the Al-based plated layer (reference numeral 14 in FIG. 2) and the base material (reference numeral 15 in FIG. 2). The thickness of the interface alloy layer to be formed can be controlled by adjusting a dipping time in the hot-dip aluminum plating bath, and the thickness can be increased by extending the dipping time.

The chemical composition of the hot-dip aluminum plating bath for forming the above-described Al-based plated layer is not particularly limited. However, the content of Al in the hot-dip aluminum plating bath is preferably 80 mass % or more in terms of being excellent in heat resistance. Further, the content of Si in the hot-dip aluminum plating bath is preferably 2 mass % or more in terms of easy control of the thickness of the interface alloy layer. When the content of Si is less than 2 mass %, the interface alloy layer becomes excessively thick, which may reduce the moldability. On the other hand, when the content of Si in the hot-dip aluminum plating bath exceeds 15 mass %, the alloying speed of the Al-based plated layer during the hot-stamping heating becomes slow, which may reduce the productivity in the hot stamping. Therefore, the content of Si in the hot-dip aluminum plating bath is preferably 15 mass % or less. When Si is not contained in the hot-dip aluminum plating bath, the interface alloy layer is composed of an Al—Fe-based binary alloy layer, and when Si is contained in the bath, the interface alloy layer is composed of an Al—Fe—Si-based ternary alloy layer, in addition to the aforementioned binary alloy layer. Further, in the hot-dip aluminum plating bath as described above, various impurities exist in some cases.

When the Al-based plated layer 14 contains Si of 2 mass % or more and 15 mass % or less, a eutectic structure of Al and Si is formed in the Al-based plated layer 14 based on a constitution diagram. In the case of the hot-dip plating method, in the hot-dip aluminum plating bath, Fe is inevitably contained by 1 mass % or more and 5 mass % or less in some cases as an eluted component from the steel sheet. Examples of other inevitable impurity include eluted components in a hot-dip plating facility and elements such as Cr, Mn, V, Ti, Sn, Ni, Cu, W, Bi, Mg, and Ca caused from the impurity in an ingot of the hot-dip aluminum plating bath, and those elements are contained by less than 1 mass % in some cases.

The above-described interface alloy layer is composed of a combination of phases such as, for example, a θ-phase ($FeAl_3$), a η-phase ($Fe_2Al_5$), a ζ-phase ($FeAl_2$), $Fe_3Al$, and FeAl each being a binary alloy of Al and Fe, and a BCC-phase of Fe in which Al is solid-dissolved. Examples of the chemical composition of the interface alloy layer in the case of containing Si include, for example, a τ1-phase ($Al_2Fe_3Si_3$), a τ2-phase ($Al_3FeSi$), a τ3-phase ($Al_2FeSi$), a τ4-phase ($Al_3FeSi_2$), a τ5-phase ($Al_8Fe_2Si$), a τ6-phase ($Al_9Fe_2Si_2$), a τ7-phase ($Al_3Fe_2Si_3$), a τ8-phase ($Al_2Fe_3Si_4$), a τ10-phase ($Al_4Fe_{1.7}Si$), a τ11-phase ($Al_5Fe_2Si$), and so on, and the chemical composition is mainly composed of any of the τ5-phase, the τ6-phase, the θ-phase, and the q-phase, or a plurality of phases of those. Note that the above-described phases do not have a stoichiometric composition (namely, an element ratio does not take an integer) in some cases.

<Regarding Sheet Thickness>

In the present embodiment, the total sheet thickness (t1+t2) of the overlapped first steel sheet 1 having the sheet thickness t1 (mm) and second steel sheet 2 having the sheet thickness t2 (mm) is 2.5 mm or more and 5.0 mm or less.

In the present embodiment, as the characteristic required for the Al-based plated steel sheet, it is important that the warpage occurred due to the difference in temperature raising rate between the overlapped part having a low temperature raising rate and the one-sheet part having a high temperature raising rate, which is the problem when used as the overlapped blank, can be further suppressed. In order to suppress the warpage as described above, the total sheet thickness (t1+t2) of the overlapped portion (overlapped part) of the first steel sheet 1 with the sheet thickness t1 (mm) and the second steel sheet 2 with the sheet thickness t2 (mm), is set to 2.5 mm or more and 5.0 mm or less. When the total sheet thickness (t1+t2) becomes less than 2.5 mm, the warpage occurs greatly, which reduces the productivity during the hot-stamping heating. The total sheet thickness (t1+t2) is preferably 2.8 mm or more, and more preferably 3.0 mm or more. On the other hand, when the total sheet thickness (t1+t2) exceeds 5.0 mm, the heat capacity becomes excessively large, and the temperature raising rate during the hot-stamping heating becomes low to reduce the productivity in heating, which is not preferable. The total sheet thickness (t1+t2) is preferably 4.8 mm or less, and more preferably 4.5 mm or less.

Here, each of the sheet thickness t1 of the first steel sheet 1 and the sheet thickness t2 of the second steel sheet 2 is preferably within a range of about 1.0 mm to 4.0 mm, for example.

Note that the sheet thickness t1 of the first steel sheet 1 and the sheet thickness t2 of the second steel sheet 2 can be measured by using a micrometer, and can also be measured by observing a cross section by using an optical microscope. Further, each of the above sheet thickness t1 and t2 is a sheet thickness including the thicknesses of the Al-based plated layers provided on both faces in addition to the sheet thickness of the base material.

<Regarding Maximum Length L of Overlapped Portion>

In the present embodiment, the maximum length L of the portion at which the first steel sheet 1 and the second steel sheet 2 are overlapped (overlapped part) is 100 mm or more and 1100 mm or less. The reason why the maximum length L of the overlapped portion is set to fall within the above-described range, will be described again hereinbelow.

Figure 4:
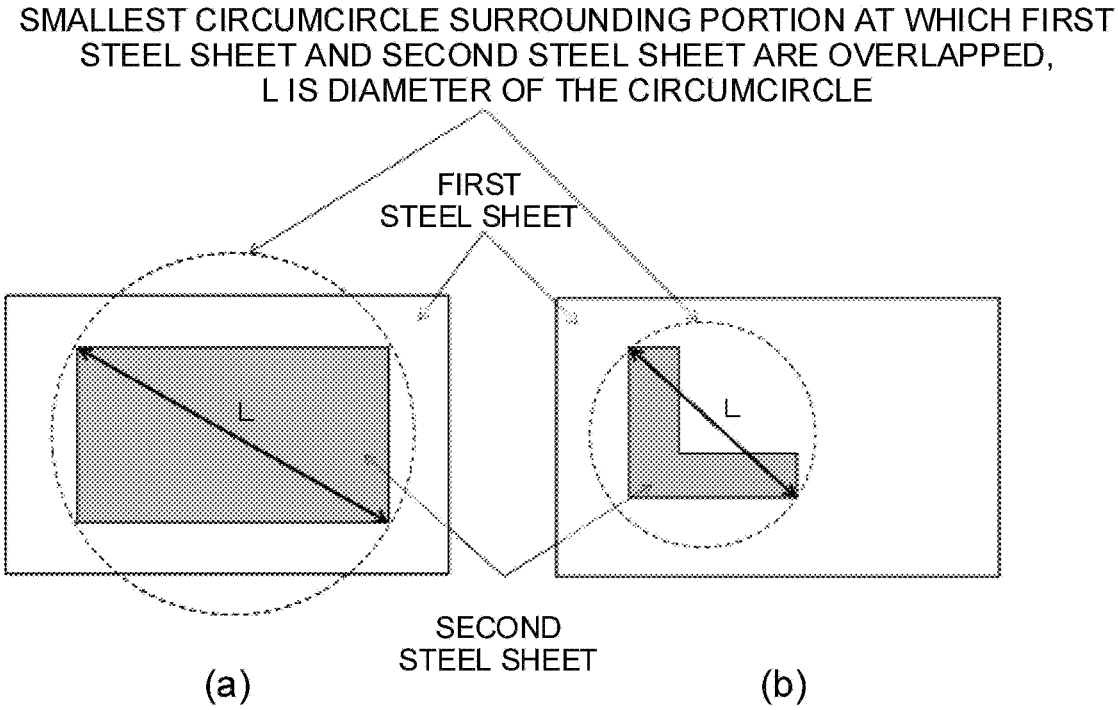
FIGS. 4(*a*) and 4(*b*) are views each schematically illustrating a maximum length L of a portion at which a first steel sheet and a second steel sheet are overlapped.

Note that the maximum length L of the portion at which the first steel sheet 1 and the second steel sheet 2 are overlapped (overlapped part) can be measured by using publicly-known measuring devices such as a caliper and a tape measure. Further, the maximum length L of the overlapped portion (overlapped part) is set to a diameter of a smallest circumcircle surrounding the portion at which the first steel sheet 1 and the second steel sheet 2 are overlapped. According to this definition, when the overlapped portion has a quadrangular shape as illustrated in FIG. 4(*a*), for example, a length of each of diagonal lines of four corners becomes the maximum length L. Further, in a case as illustrated in FIG. 4(*b*), the maximum length L is a diameter of a smallest circumcircle as illustrated in the drawing.

(2-2. Regarding Heating of Overlapped Blank During Hot Stamping)

The warpage due to the difference in temperature raising rate between the overlapped part having a low temperature raising rate and the one-sheet part having a high temperature raising rate, is caused by the temperature difference between the overlapped part and the one-sheet part, according to following Expression (A).

A difference ΔL [mm] in linear expansion in the following Expression (A) leads to the warpage, and ΔL is expressed by a product of a linear expansivity α [1/° C.] inherent in the material, a length Ls [mm] of the material, and a temperature difference ΔT [° C.] of the material. Therefore, in the blank according to the present embodiment, the length Ls in the following Expression (A) corresponds to the maximum length L of the overlapped part.

$$\Delta L = \alpha \times Ls \times \Delta T \qquad \text{Expression (A)}$$

Accordingly, when the maximum length L of the overlapped part is short, ΔL becomes small, resulting in that the warpage is also suppressed. However, when the maximum length L of the overlapped part is less than 100 mm, the warpage occurs since the difference in temperature occurs from an end portion at which the temperature raises quickly toward a center portion at which the temperature raises slowly, within the blank of the non-overlapped portion. From such a viewpoint, the maximum length L of the overlapped part is set to 100 mm or more. This can prevent the occurrence of warpage when heating the blank. The maximum length L of the overlapped part is preferably 200 mm or more, and more preferably 400 mm or more. On the other hand, when the maximum length L of the overlapped part exceeds 1100 mm, the warpage becomes large, which reduces the productivity during the hot-stamping heating. From such a viewpoint, the maximum length L of the overlapped part is set to 1100 mm or less. This can prevent the occurrence of warpage during heating while securing the productivity. The maximum length L of the overlapped part is preferably 1050 mm or less, and more preferably 1000 mm or less.

<Regarding Relation Between Area S1 of First Steel Sheet and Area S2 of Second Steel Sheet>

The warpage of the blank during heating is suppressed by an own weight of the portion of the first steel sheet 1, at which the first steel sheet 1 and the second steel sheet 2 are not overlapped (one-sheet part). Accordingly, in the present embodiment, out of an area of the second steel sheet 2, an area of a portion overlapped with the first steel sheet 1 is set to S2 ($cm^2$), and a value obtained by multiplying a difference between an area S1 of the first steel sheet and the aforementioned area S2 by the sheet thickness t1 of the first steel sheet 1 $\{(S1-S2)\times(t1/10)\}$ (unit: $cm^3$) is used as an index corresponding to the above-described own weight of the one-sheet part. Here, the reason why the sheet thickness t1 (mm) is divided by 10 is for performing conversion on the unit of the sheet thickness t1 from mm into cm. Further, regarding the area S2, when there exists no portion of the second steel sheet 2 protruding from the first steel sheet 1, the area of the second steel sheet 2 corresponds to the above-described area S2.

The present inventors conducted earnest studies by using the above-described index, and consequently, it was clarified that the warpage during heating can be suppressed when a value of the index {(S1−S2)×(t1/10)} becomes 400 or more and 950 or less. Here, a conventional overlapped blank is required to reduce its weight, which is important for a steel sheet for an automobile. For this reason, by keeping the area S2 of the second steel sheet which serves as reinforcement to the minimum, the value of the index {(S1−S2)×(t1/10)} exceeded 950 in some cases, or by keeping the area S1 or the sheet thickness t1 of the first steel sheet to the minimum, the value of the index {(S1−S2)×(t1/10)} was less than 400 in some cases. However, in order to respond to the increase in demand for the collision safety in recent years, it is required to increase the value of each of S1, S2, and t1, which newly generated a problem of the warpage of the blank. Accordingly, it was clarified by the present inventors that the warpage during heating can be suppressed by setting the value of the index {(S1−S2)×(t1/10)} to 400 or more and 950 or less. When the value of the index {(S1−S2)×(t1/10)} is less than 400, the effect of suppressing the warpage is poor. When the value of the index {(S1−S2)×(t1/10)} becomes 400 or more, it becomes possible to suppress the warpage which may occur during heating. The value of the index {(S1−S2)×(t1/10)} is preferably 420, and more preferably 440. On the other hand, when the value of the index {(S1−S2)×(t1/10)} exceeds 950, the size of the entire blank becomes large, and thus the height of warpage becomes large. When the value of the index {(S1−S2)×(t1/10)} becomes 950 or less, it becomes possible to reduce the height of the warpage which may occur during heating. The value of the index {(S1−S2)×(t1/10)} is preferably 930 or less, and more preferably 900 or less.

<Regarding Bonding>

In the overlapped blank for hot stamping in which the first steel sheet 1 and the second steel sheet 2 are overlapped and bonded, the aforementioned bonding is preferably spot welding. The reason thereof will be explained below.

At the overlapped part, the first steel sheet 1 and the second steel sheet 2 are brought into good contact to improve heat transfer. Consequently, it is possible to suppress the difference in temperature raising rate between the overlapped part (low in temperature raising rate) and the one-sheet part (high in temperature raising rate) which is the problem when used as the overlapped blank, and to suppress the warpage.

As the kind of the bonding, spot welding, seam welding, braze welding, laser welding, plasma welding, arc welding, or the like can be selected. In terms of efficiently bringing the overlapped part having a large area into good contact, the spot welding which can establish contact even at the inside of the overlapped part at a plurality of points and establish a direct bond by applying a pressure between the steel sheets is preferable.

At this time, a spot density of the spot welding is preferably 1 spot/200 $cm^2$ or more. When the spot density is less than 1 spot/200 $cm^2$, the contact between the steel sheets becomes insufficient, resulting in insufficient improvement in temperature raise at the overlapped part. The spot density of the spot welding is more preferably 1 spot/40 $cm^2$ or more. On the other hand, the upper limit of the spot density of the spot welding is not particularly defined, but is preferably 1 spot/1 $cm^2$ or less because when the density is too high, a shunt current occurs in a welding current to make the welding difficult.

The spot density (spot/$cm^2$) of the spot welding is determined by dividing the number of spots of the spot welding in the second steel sheet 2 treated into the blank by the area of the portion, of the second steel sheet 2, which is overlapped with the first steel sheet 1.

<Regarding Temperature Raising Rate During Heating>

In the present embodiment, an average heating rate V (° C./s) at a sheet temperature from 20 to 800° C. of a portion with a total sheet thickness (t1+t2) (mm) at which the first steel sheet 1 and the second steel sheet 2 are overlapped, and an average heating rate v1 (° C./s) at a sheet temperature from 20 to 800° C. of a portion, of the first steel sheet 1, which is not overlapped with the second steel sheet 2, satisfy relational expressions of following Expression (1) and Expression (2). The reason thereof will be explained below.

$$1.0 \leq V \leq 4.0 \quad \text{Expression (1)}$$

$$(v1 - V) \leq 3.0 \quad \text{Expression (2)}$$

Figure 5:
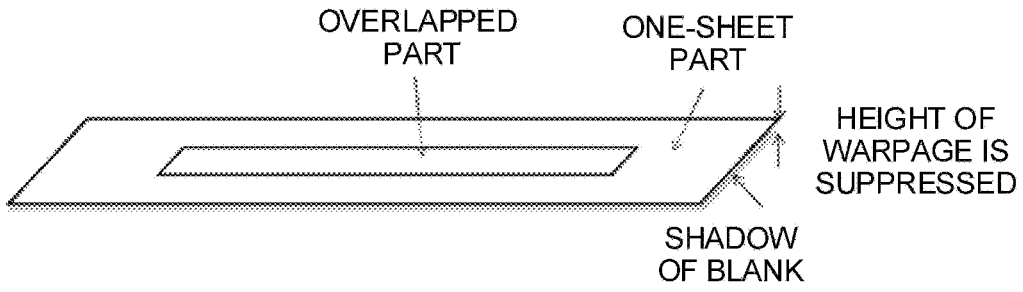
FIG. 5 is a view schematically illustrating an example of suppressing warpage in a case where a difference in temperature raising rate at 20 to 800° C. between a one-sheet part and an overlapped part is 2° C./s in the middle of the raise in temperature in the step of heating the blank.
Figure 6:
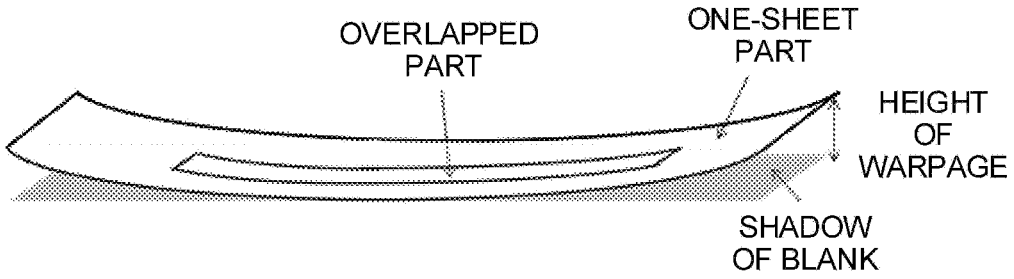
FIG. 6 is a view schematically illustrating an example in which warpage occurs in a case where a difference in temperature raising rate at 20 to 800° C. between a one-sheet part and an overlapped part is 4° C./s in the middle of the raise in temperature in the step of heating the blank.

The warpage due to the difference in temperature raising rate between the overlapped part having a low temperature raising rate and the one-sheet part having a high temperature raising rate, is caused by the temperature difference between the overlapped part and the non-overlapped portion, according to the above-described Expression (A). Therefore, by suppressing the difference in average heating rate (v1−V) for reducing the temperature difference ΔT of the material between the overlapped part and the non-overlapped portion, the warpage is reduced. More specifically, by setting the difference in average heating rate (v1−V) to 3.0° C./s or less, the warpage is suppressed as schematically illustrated in FIG. 5, for example, resulting in that the reduction in productivity during hot-stamping heating is improved. On the other hand, when the difference in average heating rate (v1−V) exceeds 3.0° C./s, the warpage becomes large as schematically illustrated in FIG. 6, for example, resulting in that the productivity during hot stamping is reduced. The difference in average heating rate (v1−V) is preferably 2.8° C./s or less, and more preferably 2.6° C./s or less. Note that a lower limit of the difference in average heating rate (v1−V) is not particularly defined, but industrially, the lower limit of the difference in average heating rate (v1−V) is 0.5° C./s or more.

Further, the overlapped blank is gradually heated from an end portion within a blank face at which the temperature raising rate is high toward a center portion at which the temperature raising rate is low. Accordingly, by gradually heating the overlapped part at the average heating rate V within a range of 1.0° C./s or more and 4.0° C./s or less, it is possible to improve the warpage by suppressing the difference in temperature between the one-sheet part and the overlapped part. When the average heating rate V of the overlapped part exceeds 4.0° C./s, there arises a problem that the warpage is formed excessively. An upper limit of the average heating rate V of the overlapped part is preferably 3.8° C./s or less, and more preferably 3.6° C./s or less. On the other hand, when the average heating rate V of the overlapped part is less than 1.0° C./s, the temperature raising rate during heating is excessively low, resulting in that the productivity in heating is reduced. A lower limit of the average heating rate V of the overlapped part is preferably 1.2° C./s or more, and more preferably 1.4° C./s or more.

Note that the average heating rate V [° C./second] of the overlapped part and the average heating rate v1 [° C./second] of the one-sheet part described above can be determined in a manner that K-type thermocouples are connected to the steel sheet through spot welding, a sheet temperature is measured until when a heating temperature reaches 800° C. from 20° C., and 780° C. (=800° C.−20° C.) is divided by a period of time (second) from when the heating is started to when the sheet temperature reaches 800° C. from 20° C. However, when the sheet temperature already exceeds 20° C. before starting the heating due to the reason such that the room temperature is high at a point of time of staring the raise in temperature, for example, when the sheet temperature is 25° C., the average heating rates are determined by dividing 775° C. (=800° C.−25° C.) by a period of time (second) during which the sheet temperature reaches 800° C. from 25° C.

<Regarding Time and Temperature During Heating>

Figure 7:
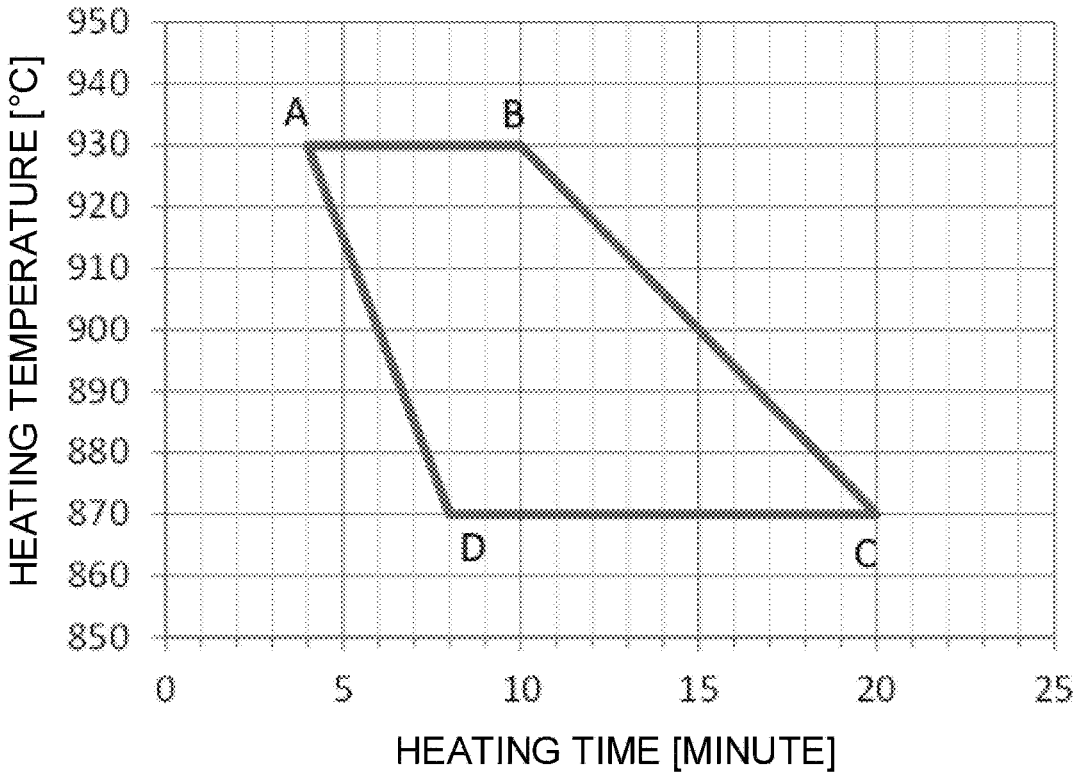
FIG. 7 is a view illustrating a heating temperature and a heating time positioned within a figure ABCD defined by a point A (4 minutes, 930° C.), a point B (10 minutes, 930° C.), a point C (20 minutes, 870° C.), and a point D (8 minutes, 870° C.), on a plane of coordinates defined by (heating time, temperature in preheated furnace) in a step of heating an overlapped hot stamp molded body.

In the present embodiment, the overlapped blank (reference numeral 4 in FIG. 1) is heated at a heating temperature and for a heating time positioned within a figure ABCD defined by a point A (4 minutes, 930° C.), a point B (10 minutes, 930° C.), a point C (20 minutes, 870° C.), and a point D (8 minutes, 870° C.) on a plane of coordinates defined by (heating time, heating temperature), as illustrated in FIG. 7. The heating temperature mentioned here means a temperature in a furnace of a preheated heating furnace, and the overlapped blank carried in the furnace is heated to the temperature of the preheated furnace. Further, the heating time mentioned here means a period of time from when the overlapped blank is carried in the furnace of the heating furnace to when it is carried out of the furnace.

When the heated overlapped blank is carried out of the heating furnace, it is important that the warpage is improved, in terms of the stability of transfer of the overlapped blank. However, in order to reduce the difference in temperature raising rate between the overlapped part at which the temperature raises slowly and the one-sheet part at which the temperature raises quickly, it is required to heat the blank in the furnace for a certain period of time or more so that the temperature in the blank is equalized between the overlapped part and the one-sheet part. For this reason, by heating the overlapped blank at a heating temperature and for a heating time positioned within the figure ABCD illustrated in FIG. 7, it is possible to improve the warpage at a time of carrying the heated overlapped blank out of the heating furnace.

When the heating time at the heating temperature of 930° C. is less than 4 minutes, the temperature difference between the overlapped part having a low temperature raising rate and the one-sheet part having a high temperature raising rate is not sufficiently equalized, resulting in that the warpage is not sufficiently corrected and the heated overlapped blank cannot be stably grasped when it is transferred. The heating time is preferably 4.5 minutes or more, and more preferably 5 minutes or more. Further, when the heating time at the heating temperature of 870° C. is less than 8 minutes, the warpage is not sufficiently corrected and the heated overlapped blank cannot be stably grasped when it is transferred, in a similar manner to the above. The heating time is preferably 8.5 minutes or more, and more preferably 9 minutes or more.

Further, when the heating time at the heating temperature of 930° C. exceeds 10 minutes, the productivity in heating is reduced, and in addition to that, the diffusion of Fe into the plating proceeds excessively, resulting in that the corrosion resistance of the hot stamp molded body is reduced. In particular, the corrosion resistance of the one-sheet part having a low temperature raising rate is reduced. For this reason, the heating time at the heating temperature of 930° C. is preferably 9.5 minutes or less, and more preferably 9 minutes or less. In a similar manner, when the heating time at the heating temperature of 870° C. exceeds 20 minutes, the corrosion resistance of the one-sheet part having a low temperature raising rate is reduced. For this reason, the heating time at 870° C. is preferably 18 minutes or less, and more preferably 16 minutes or less.

When the heating temperature exceeds 930° C., the difference in temperature raising rate between the overlapped part and the one-sheet part is increased, resulting in that the warpage becomes large. An upper limit of the heating temperature is preferably 920° C., and more preferably 910° C. On the other hand, when the heating temperature is less than 870° C., the base material of the overlapped blank is insufficiently turned into y (austenite), which reduces the hardness after die-quenching, and further, the heating rate is decreased to lower the productivity. A lower limit of the heating temperature is preferably 875° C., and more preferably 880° C.

In the present embodiment, the overlapped blank is heated at a heating temperature and for a heating time positioned within the range of the figure ABCD illustrated in FIG. 7. Accordingly, a point E (6 minutes, 900° C.) positioned between a line segment AD, a point F (15 minutes, 900° C.) positioned between a line segment BC, a point G (10 minutes, 900° C.) positioned between a line segment EF, and the like are also within the range of the present invention.

As a heating furnace used for the above-described heating method, it is possible to use a roller hearth furnace and a multistage furnace. As a heat source, there can be exemplified heating by using an electric furnace, a gas furnace, a far-infrared furnace, or a near-infrared furnace, energization heating, high-frequency heating, induction heating, or the like.

(2-3. Regarding Process of Carrying Overlapped Blank Out of Heating Furnace and Transferring it to Pressing Apparatus)

The heated overlapped blank is carried out of the heating furnace, and transferred to the pressing apparatus. When the heated overlapped blank is cooled to 650° C. or less before being subjected to rapid cooling in the die, the martensite transformation occurs insufficiently. Accordingly, a period of time from when the overlapped blank is carried out of the heating furnace to when it is transferred to the pressing apparatus is preferably within 20 seconds.

(2-4. Regarding Hot Pressing Step)

By performing presswork on the heated overlapped blank by using a die, a hot stamp molded body can be obtained. When performing the presswork by using the die, the martensite transformation proceeds by rapidly cooling the heated overlapped blank by using the die. Consequently, it is possible to obtain a molded body having hardness of 300 HV or more in terms of Vickers hardness when a load is set to 9.81 N. A rapid cooling rate in the die regarding each of the overlapped part and the one-sheet part is preferably 30° C./s or more, and is more preferably 50° C./s or more. Note that the rapid cooling rate mentioned here indicates an average cooling rate from when the heated overlapped blank is carried out of the heating furnace to when it is cooled to 400° C. or less.

The above is the detailed explanation regarding the method of manufacturing the overlapped hot stamp molded body according to the present embodiment.

(3. Regarding Overlapped Hot Stamp Molded Body)

The overlapped hot stamp molded body 12 according to the present embodiment includes a first steel sheet having a sheet thickness of t1 (mm) and at least one second steel sheet bonded by being overlapped on the first steel sheet, having an area smaller than that of the first steel sheet, and having a sheet thickness of t2 (mm).

Both faces of each of the first steel sheet and the second steel sheet in the overlapped hot stamp molded body 12 are covered with an Al—Fe-based plated layer.

Figure 8:
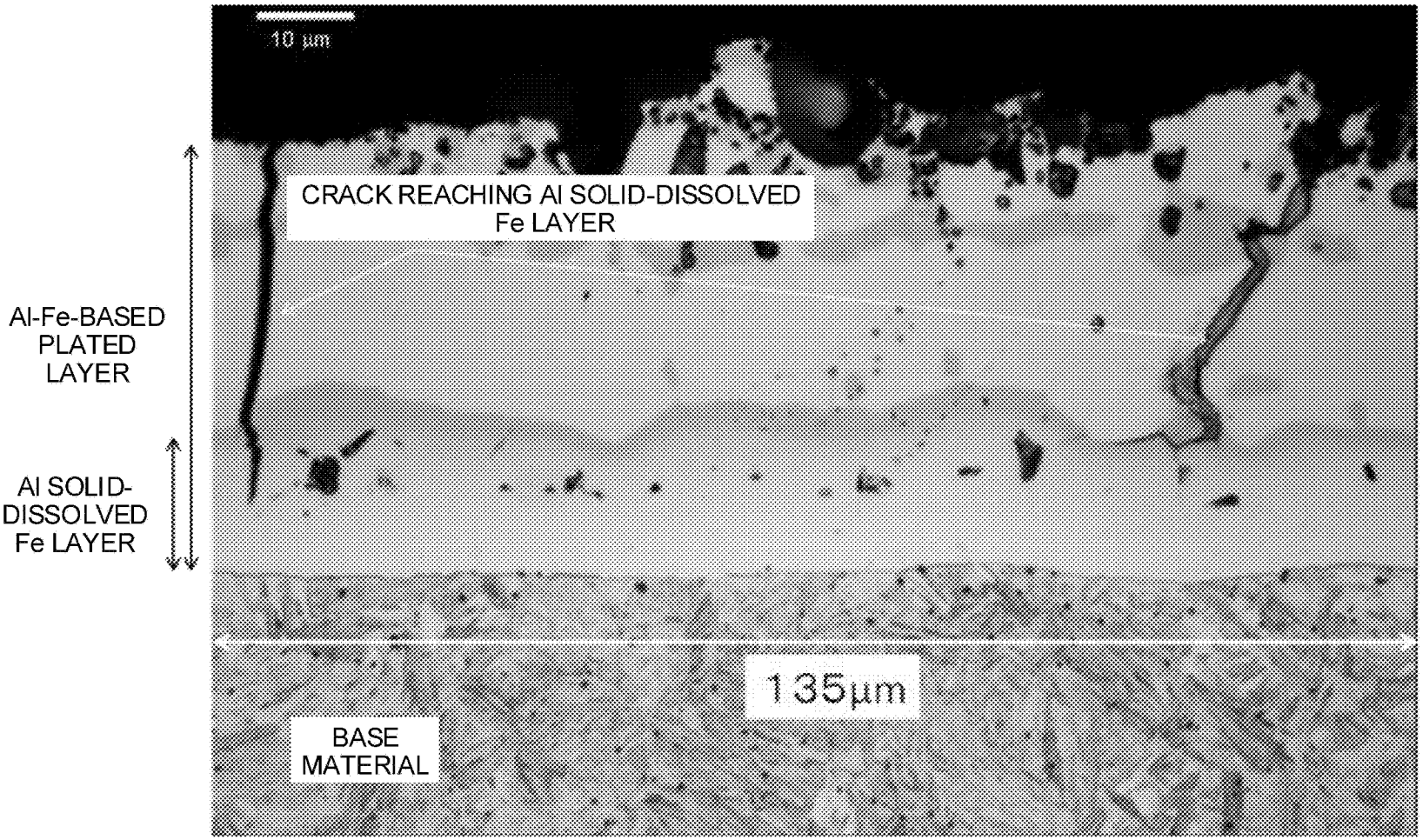
FIG. 8 is a view illustrating one example of cracks formed on a portion corresponding to a plating surface denoted by 1*b* in FIG. 1, in an overlapped hot stamp molded body.

The Al—Fe-based plated layer is a layer which is formed as a result of diffusion of Fe to a surface of an Al-based plated layer due to heating during hot stamping (in other words, an alloy plated layer containing at least Al and Fe). The Al—Fe-based plated layer is composed of a combination of phases such as a θ-phase ($FeAl_3$), a η-phase ($Fe_2Al_5$), a ζ-phase ($FeAl_2$), $Fe_3Al$, and FeAl each being a compound layer of Al and Fe. Further, the Al—Fe-based plated layer in the case of containing Si in the plating also contains a τ1-phase ($Al_2Fe_3Si_3$), a τ2-phase ($Al_3FeSi$), a τ3-phase ($Al_2FeSi$), a τ4-phase ($Al_3FeSi_2$), a τ5-phase ($Al_8Fe_2Si$), a τ6-phase ($Al_9Fe_2Si_2$), a τ7-phase ($Al_3Fe_2Si_3$), a τ8-phase ($Al_2Fe_3Si_4$), a τ10-phase ($Al_4Fe_{1.7}Si$), and a τ11-phase ($Al_5Fe_2Si$), and the compound layer of Al and Fe is mainly composed of any of the τ1-phase and the η-phase ($Fe_2Al_5$), or a plurality of phases thereof. In particular, Al in the plating and Fe in the base material diffuse to each other. A layer containing a BCC-phase of Fe in which Al is solid-dissolved or a phase of FeAl, which is formed through the diffusion of Al into the base material, is referred to as an Al solid-dissolved Fe layer, and this layer is a layer adjacent to the base material, as illustrated in FIG. 8. Under the heating condition of the present embodiment, the compound layer as described above which contains at least Al and Fe is formed, and in addition to that, the Al solid-dissolved Fe layer is formed as a lowermost layer of plating positioned on the base material side, as exemplified in FIG. 8. The Al—Fe-based plated layer according to the present embodiment is set to include the compound layer of Al and Fe as described above, and the Al solid-dissolved Fe layer, as illustrated in FIG. 8.

A plating thickness of the Al—Fe-based plated layer is preferably 10 μm to 50 μm in each of the first steel sheet and the second steel sheet independently. When the plating thickness of the Al—Fe-based plated layer is less than 10 μm, the corrosion resistance of the overlapped hot stamp molded body is reduced. On the other hand, when the plating thickness of the Al—Fe-based plated layer exceeds 50 μm, there arises a problem that the powdering during press molding occurs frequently. The plating thickness of the Al—Fe-based plated layer is more preferably 15 μm to 45 μm.

A difference between a thickness D1 (μm) of the Al solid-dissolved Fe layer of a portion, of the first steel sheet, which is not overlapped with the second steel sheet and a thickness D2 (μm) of the Al solid-dissolved Fe layer of the second steel sheet (D1−D2) is 6.0 μm or less. It is known that the corrosion resistance of the Al—Fe-based plated layer is suppressed by the Al—Fe binary alloy ($FeAl_3$, $Fe_2Al_5$, $FeAl_2$), and there is a relation in which when the Al solid-dissolved Fe layer becomes thin, the Al—Fe binary alloy becomes thick. Accordingly, when the difference (D1−D2) exceeds 6.0 μm, an amount of the Al solid-dissolved Fe layer in the first steel sheet becomes large, resulting in that the Al—Fe binary alloy becomes thin and the corrosion resistance is reduced. Further, in a case where structures of the Al—Fe-based plated layers are different, at the overlapped part between the first steel sheet and the second steel sheet, galvanic corrosion occurs to reduce the corrosion resistance in some cases. Accordingly, it was found that it is important, for the corrosion resistance of the overlapped part, to suppress the difference in thickness of the Al solid-dissolved Fe layer between the first steel sheet and the second steel sheet (D1−D2) to 6 μm or less. An upper limit of the difference (D1−D2) is preferably 5.5 μm or less, and more preferably 5.0 μm or less. Although a lower limit of the difference (D1−D2) is not particularly defined, when it is less than 0.5 μm, the effect saturates.

As a method of specifying the plating thickness of the Al—Fe-based plated layer and a thickness of the Al solid-dissolved Fe layer, an optical microscope is used to observe the cross section of plating after performing nital etching in a field of view of 100 μm×100 μm, and the thicknesses can be determined by measuring the plating thickness and the thickness of the Al solid-dissolved Fe layer adjacent to the base material, as illustrated in FIG. 8. More specifically, the cross section of plating is observed through the above-described method at arbitrary plural locations (3 locations, for example), and the plating thickness and the thickness of the Al solid-dissolved Fe layer at each observation location are specified. After that, average values of the obtained thicknesses are calculated, and the obtained average values may be set to the plating thickness and the thickness of the Al solid-dissolved Fe layer.

Further, attention is focused on a crack reaching the Al solid-dissolved Fe layer, the crack being formed in the Al—Fe-based plated layer on a face (reference numeral 1*b* in FIG. 1) not in contact with the second steel sheet of the first steel sheet at the portion at which the first steel sheet and the second steel sheet are overlapped, after the hot stamping. When the number of such cracks is 5 or less per length of 100 μm parallel to the Al—Fe-based plated layer (in other words, when the number of such cracks is 1 or less per length of 20 μm parallel to the Al—Fe-based plated layer), the corrosion resistance is improved. The crack causes red rust of plating, and it can be considered that the crack occurred due to the warpage during the hot-stamping heating. By improving the warpage through the method of manufacturing the overlapped hot stamp of the present embodiment described above, the occurrence of crack can also be suppressed. When the number of the cracks exceeds 5 per length of 100 μm, the occurrence of red rust becomes a problem. The number of the cracks is preferably 3 or less per length of 100 μm, and more preferably 2 or less per length of 100 μm.

As a method of measuring the cracks reaching the Al solid-dissolved Fe layer and formed in the Al—Fe-based plated layer as exemplified in FIG. 8, an optical microscope is used to observe the cross section of plating after performing nital etching in a field of view of 100 μm×100 μm or more, and the number of cracks can be determined by measuring it. As illustrated in FIG. 8 as well, the Al solid-dissolved Fe layer is a layer formed right above the base material being the martensite structure. In the example of FIG. 8, 2 cracks exist per 135 μm, and thus 1.5 cracks/100 μm occur.

The above is the detailed explanation regarding the overlapped hot stamp molded body according to the present embodiment.

EXAMPLES

Hereinafter, the present invention will be further concretely explained using examples.

Example 1

A slab having a steel component containing chemical components of, by mass %, C: 0.21%, Si: 0.20%, Mn: 1.20%, P: 0.010%, S: 0.0020%, N: 0.0030%, Al: 0.04%, and B: 0.0020%, with the balance made up of Fe and impurities, was subjected to ordinary hot-rolling step and cold-rolling step to be a cold-rolled steel sheet, and then the aluminum plating treatment was performed on its both faces on a Sendzimir hot-dip aluminum plating treatment line, to thereby obtain a sample material A of an Al-based plated steel sheet. In like manner, a slab having a steel component containing chemical components of, by mass %, C: 0.21%, Si: 0.20%, Mn: 1.20%, P: 0.010%, S: 0.0080%, N: 0.0030%, Al: 0.04%, B: 0.0020%, W: 0.1%, Cr: 0.3%, Mo: 0.1%, V: 0.1%, Ti: 0.02%, Nb: 0.02%, Ni: 0.1%, Cu: 0.1%, Co: 0.1%, Sn: 0.01%, Sb: 0.01%, Mg: 0.0010%, Ca: 0.0020%, O: 0.0020%, and REM: 0.0030%, with the balance made up of Fe and impurities, was subjected to a hot-rolling step and a cold-rolling step to be a cold-rolled steel sheet, and then the aluminum plating treatment was performed on its both faces, to thereby obtain a sample material B. Further, materials each being the sample material A in which the C amount was set to 0.35%, 0.27%, and 0.45%, respectively, were used as sample materials C, D, and E. After the plating, the plating deposition amount of each of the sample materials A, B, C, D, and E was adjusted by the gas wiping method, and then cooling was performed. The plating bath composition when performing the aluminum plating treatment was 89% Al—9% Si—2% Fe. The plating thickness of the Al-based plated layer was 25 μm. The sheet thickness was adjusted to a thickness of 1.0 mm to 4.0 mm, as listed in Table 1 below.

A first steel sheet in a size of 1200×300 mm and a second steel sheet cut in a size ranging from 40×30 mm to 1196×100 mm were prepared by being overlapped with each other so as to satisfy the total sheet thickness (t1+t2) and the maximum length L listed in Table 1 below. In the present example, the second steel sheet was overlapped with the first steel sheet so that no portion thereof protruding from the first steel sheet exists. Accordingly, in the present example, the area S2 coincides with the size of the second steel sheet. These two steel sheets were subjected to spot welding as illustrated at spots (bonded parts 3) in FIG. 1, to thereby produce an overlapped blank for hot stamping 4.

As listed in Table 1, in a step of heating the overlapped blanks produced in a manner as described above for a certain period of time in a preheated furnace, an average heating rate at a sheet temperature from 20 to 800° C. was investigated, each of the overlapped blanks was held at a targeted temperature and for a targeted time, it was then carried out of the heating furnace to be transferred in a transfer time of 10 seconds, immediately pressed at a load of 100 tons by a die and simultaneously cooled in the die, to thereby obtain a hat-shaped overlapped hot stamp molded body. The cooling rate at this time was 50° C./s.

The sheet temperature of the overlapped blank during the raise in temperature was measured by spot-welding K-type thermocouples to the non-overlapped portion (one-sheet part having high temperature raising rate) of the first steel sheet, and the overlapped second steel sheet (overlapped part having low temperature raising rate).

Further, in order to check the warpage during heating of the overlapped blank, there was provided a gap from which the inside of the furnace can be observed, and the maximum value of the warpage of the overlapped blank in the middle of the raise in temperature was actually measured. As a method of the actual measurement, blocks having heights of 40 mm, 50 mm, and 70 mm, were disposed in the furnace, and then a case where the warpage was greater than 70 mm was judged as NG (No Good) since it causes problems in mass production, a case where the warpage was 70 mm or less and greater than 50 mm was judged as G3 (Good No3), a case where the warpage was 50 mm or less and greater than 40 mm was judged as G2 (Good No2), and a case where the warpage was 40 mm or less was judged as G1 (Good No1). Further, if the warpage remains when carrying out the blank after the completion of heating, there arises a problem in productivity when transferring the blank to the pressing apparatus. Accordingly, a case where the warpage of 40 mm or more was remained after the completion of heating was also judged as NG (No Good) since it causes problems in mass production. The results of judgment are listed in Table 1.

Levels are listed in Table 1 with invention examples of the present application (hereinafter, simply described as "invention examples") indicated as A1 to A16 and comparative examples indicated as a1 to a8.

Note that the sheet thicknesses of the steel sheets were respectively measured by using a micro-gauge as described above by the method described in JIS G 3314: 2011.

TABLE 1

| | | OVERLAPPED BLANK | | | | | | | | | |
|---|---|---|---|---|---|---|---|---|---|---|---|
| | | FIRST STEEL SHEET | | | SECOND STEEL SHEET | | | | | | |
| | No. | SAMPLE MATERAL | SHEET THICKNESS t1 (mm) | AREA S1 ($cm^2$) | SAMPLE MATERIAL | DIFFERENCE IN C CONTENT C2 − C1 (mass %) | SHEET THICKNESS t2 (mm) | SIZE LONG SIDE × SHORT SIDE ($mm^2$) | | AREA S2 ($cm^2$) | (S1 − S2) × (t1/10) ($cm^3$) |
| INVENTION EXAMPLE | A1 | A | 2.0 | 3600 | A | 0.00 | 2.0 | 173 | 100 | 173 | 685 |
| | A2 | A | 2.0 | 3600 | A | 0.00 | 2.0 | 490 | 100 | 490 | 622 |
| | A3 | A | 2.0 | 3600 | A | 0.00 | 2.0 | 794 | 100 | 794 | 561 |
| | A4 | A | 1.6 | 3600 | A | 0.00 | 2.0 | 794 | 100 | 794 | 449 |
| | A5 | A | 2.6 | 3600 | A | 0.00 | 2.0 | 173 | 100 | 173 | 891 |
| | A6 | A | 2.0 | 3600 | A | 0.00 | 3.0 | 490 | 100 | 490 | 622 |
| | A7 | A | 2.0 | 3600 | A | 0.00 | 3.0 | 490 | 100 | 490 | 622 |
| | A8 | A | 1.5 | 3600 | A | 0.00 | 1.5 | 490 | 100 | 490 | 467 |
| | A9 | A | 2.0 | 3600 | A | 0.00 | 1.5 | 490 | 100 | 490 | 622 |
| | A10 | B | 2.0 | 3600 | B | 0.00 | 2.0 | 490 | 100 | 490 | 622 |
| | A11 | B | 2.0 | 3600 | B | 0.00 | 2.0 | 490 | 100 | 490 | 622 |

TABLE 1-continued

| | | | | | | | | | | | |
|---|---|---|---|---|---|---|---|---|---|---|---|
| | A12 | A | 2.0 | 3600 | B | 0.00 | 2.0 | 490 | 100 | 490 | 622 |
| | A13 | A | 2.0 | 3600 | B | 0.00 | 2.0 | 490 | 100 | 490 | 622 |
| | A14 | A | 2.0 | 3600 | C | 0.14 | 2.0 | 173 | 100 | 173 | 685 |
| | A15 | A | 2.0 | 3600 | D | 0.06 | 2.0 | 173 | 100 | 173 | 685 |
| | A16 | A | 2.0 | 3600 | E | 0.24 | 2.0 | 173 | 100 | 173 | 685 |
| COMPAR- | a1 | A | 1.0 | 3600 | A | 0.00 | 1.0 | 40 | 30 | 12 | 359 |
| ATIVE | a2 | A | 4.0 | 3600 | A | 0.00 | 4.0 | 1196 | 100 | 1196 | 962 |
| EXAMPLE | a3 | A | 2.0 | 3600 | A | 0.00 | 2.0 | 1196 | 100 | 1196 | 481 |
| | a4 | A | 2.0 | 3600 | A | 0.00 | 2.0 | 490 | 100 | 490 | 622 |
| | a5 | A | 2.0 | 3600 | A | 0.00 | 4.0 | 490 | 100 | 490 | 622 |
| | a6 | A | 2.0 | 3600 | A | 0.00 | 2.0 | 490 | 100 | 490 | 622 |
| | a7 | A | 2.0 | 3600 | A | 0.00 | 2.0 | 490 | 100 | 490 | 622 |
| | a8 | A | 4.0 | 3600 | A | 0.00 | 1.0 | 490 | 100 | 490 | 1244 |

| | | OVER-LAPPED BLANK | | OVERLAPPED BLANK HEATING STEP | | | | | |
|---|---|---|---|---|---|---|---|---|---|
| | | OVER-LAPPED PART | | AVERAGE HEATING RATE | | | | | |
| | No. | TOTAL SHEET THICK-NESS (t1 + t2) (mm) | MAXIMUM LENGTH L (mm) | OVER-LAPPED PORTION V (° C./s) | FIRST STEEL SHEET AT NON-OVER-LAPPED PORTION v1 (° C./s) | DIFFER-ENCE IN AVERAGE HEATING RATE (v1 − V) (° C./s) | HEATING TEMPER-ATURE (° C.) | HEATING TIME (minute) | PROPERTY EVALU-ATION WARPAGE OF BLANK |
| INVEN- | A1 | 4.0 | 200 | 2.5 | 5.0 | 2.5 | 900 | 8 | G2 |
| TION | A2 | 4.0 | 500 | 2.5 | 5.0 | 2.5 | 900 | 8 | G1 |
| EXAMPLE | A3 | 4.0 | 800 | 2.5 | 5.0 | 2.5 | 900 | 8 | G1 |
| | A4 | 3.6 | 800 | 3.3 | 6.2 | 2.9 | 900 | 13 | G1 |
| | A5 | 4.6 | 800 | 2.5 | 5.0 | 2.5 | 900 | 13 | G1 |
| | A6 | 5.0 | 500 | 1.5 | 4.3 | 2.8 | 870 | 18 | G1 |
| | A7 | 5.0 | 500 | 2.0 | 5.0 | 3.0 | 900 | 8 | G1 |
| | A8 | 3.0 | 500 | 4.0 | 6.5 | 2.5 | 900 | 8 | G1 |
| | A9 | 3.5 | 500 | 3.5 | 5.0 | 1.5 | 900 | 8 | G1 |
| | A10 | 4.0 | 500 | 2.8 | 5.5 | 2.7 | 920 | 5 | G3 |
| | A11 | 4.0 | 500 | 2.8 | 5.5 | 2.7 | 920 | 11 | G3 |
| | A12 | 4.0 | 500 | 2.3 | 4.5 | 2.2 | 880 | 8 | G1 |
| | A13 | 4.0 | 500 | 2.3 | 4.5 | 2.2 | 880 | 16 | G1 |
| | A14 | 4.0 | 200 | 2.5 | 5.0 | 2.5 | 900 | 8 | G1 |
| | A15 | 4.0 | 200 | 2.5 | 5.0 | 2.5 | 900 | 8 | G1 |
| | A16 | 4.0 | 200 | 2.5 | 5.0 | 2.5 | 900 | 8 | G1 |
| COMPAR- | a1 | 2.0 | 50 | 5.0 | 10.0 | 5.0 | 900 | 8 | NG |
| ATIVE | a2 | 8.0 | 1200 | 0.4 | 2.5 | 2.1 | 900 | 8 | NG |
| EXAMPLE | a3 | 4.0 | 1200 | 2.5 | 5.0 | 2.5 | 900 | 8 | NG |
| | a4 | 4.0 | 500 | 2.5 | 5.0 | 2.5 | 900 | 3 | NG |
| | a5 | 6.0 | 500 | 0.8 | 5.0 | 4.2 | 900 | 21 | NG |
| | a6 | 4.0 | 500 | 2.0 | 4.0 | 2.0 | 850 | 10 | NG |
| | a7 | 4.0 | 500 | 3.0 | 6.0 | 3.0 | 950 | 5 | NG |
| | a8 | 5.0 | 500 | 2.0 | 2.5 | 0.5 | 900 | 8 | NG |

As is apparent from the above Table 1, A1 to A16 being the invention examples were judged as good since the warpage in the middle of the raise in temperature was suppressed. However, a1 to a3, and a5 to a8 being the comparative examples were judged as NG since the warpage in the middle of the raise in temperature was large. In the comparative example of a4, the warpage of 40 mm or more was remained after the completion of heating, and thus it was judged as NG.

Example 2

In a similar manner to Example 1, slabs having steel components containing chemical components of the sample materials A, B, C, D, and E were subjected to ordinary hot-rolling step and cold-rolling step to be cold-rolled steel sheets, and then the aluminum plating treatment was performed on both faces of each of the steel sheets on a Sendzimir hot-dip aluminum plating treatment line, to thereby obtain sample materials of Al-based plated steel sheets. After the plating, the plating deposition amount of each of the sample materials A, B, C, D, and E was adjusted by the gas wiping method, and then cooling was performed. The plating bath composition at this time was 89% Al—9% Si—2% Fe. Further, the plating thickness of the Al-based plated layer was 25 μm. The sheet thickness was adjusted to a thickness of 1.0 mm to 4.0 mm, as listed in Table 2 below.

A first steel sheet in a size of 1200×300 mm and a second steel sheet cut in a size ranging from 40×30 mm to 1196×100 mm were prepared by being overlapped with each other so as to satisfy the total sheet thickness (t1+t2) and the maximum length L listed in Table 2 below. In the present example, the second steel sheet was overlapped with the first steel sheet so that no portion thereof protruding from the first steel sheet exists. Accordingly, in the present example, the area S2 coincides with the size of the second steel sheet. These two steel sheets were subjected to spot welding as illustrated at spots (bonded parts 3) in FIG. 1, to thereby produce an overlapped blank for hot stamping 4.

Figure 9:
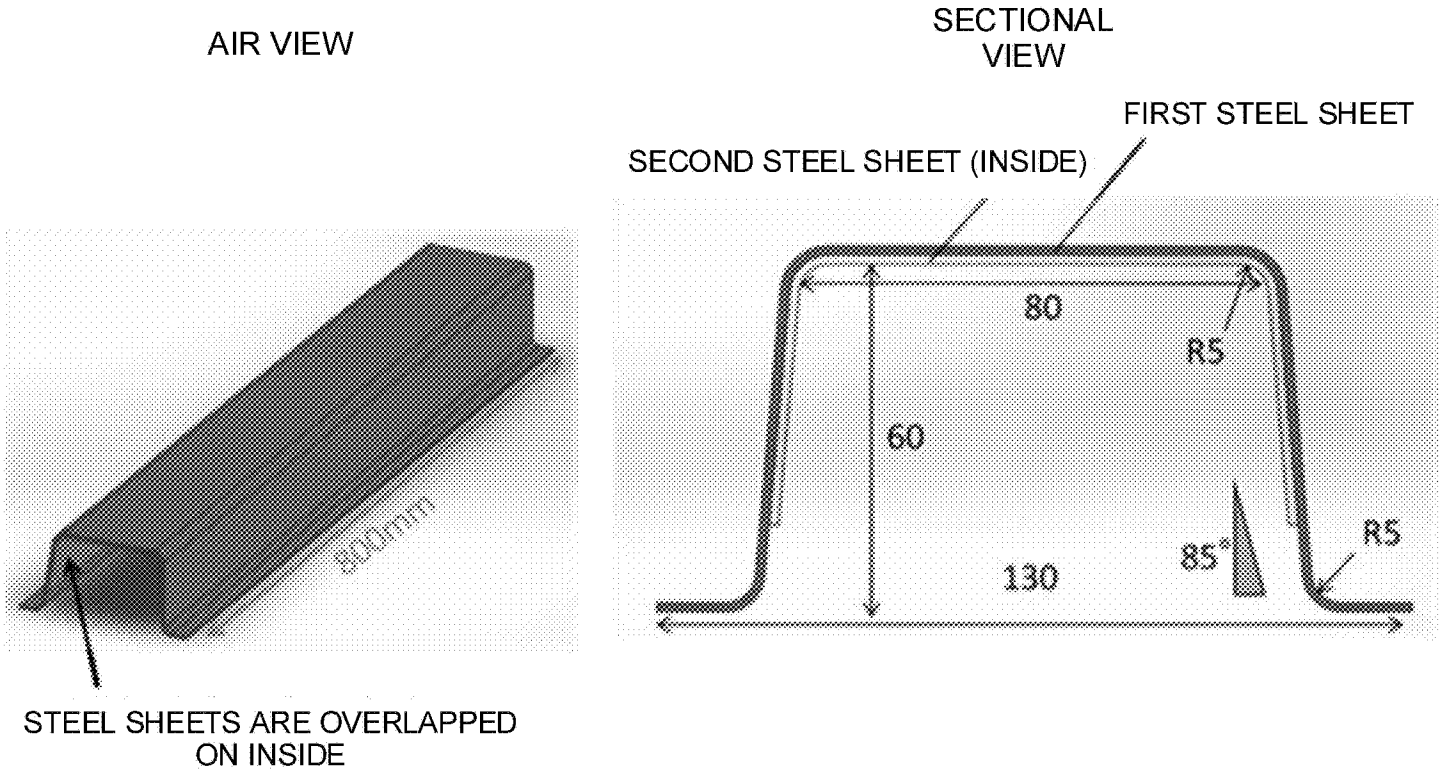
FIG. 9 is a view schematically illustrating a shape of an overlapped hot stamp molded body in a hat shape used in examples of the present invention.

As listed in Table 2, in a step of heating the overlapped blanks produced in a manner as described above for a certain period of time in a preheated furnace, an average heating rate at a sheet temperature from 20 to 800° C. was investigated, each of the overlapped blanks was held at a targeted temperature and for a targeted time, it was then carried out of the heating furnace to be transferred in a transfer time of 10 seconds, immediately pressed at a load of 100 tons by a die and simultaneously cooled in the die, to thereby obtain a hat-shaped overlapped hot stamp molded body as illustrated in FIG. 9. The cooling rate at this time was 50° C./s or more.

The sheet temperature of the overlapped blank during the raise in temperature was measured by spot-welding K-type thermocouples to the non-overlapped portion (one-sheet part having high temperature raising rate) of the first steel sheet, and the overlapped second steel sheet (overlapped part having low temperature raising rate).

From the hat-shaped molded product after this test, a head top part (reference numeral 7 in FIG. 1) was cut out in a size of 100×50 mm, an end face thereof was protected by a tape, and then a salt spray test (JIS Z 2371: 2015) was carried out to evaluate the corrosion resistance. The evaluation was carried out at a face not in contact with the second steel sheet of the first steel sheet (reference numeral 1*b* in FIG. 1). After 24 hours, a case where a red rust area ratio was greater than 50% was judged as NG (No Good), a case where the red rust area ratio was greater than 30% and 50% or less was judged as G3 (Good No3), a case where the red rust area ratio was greater than 20% and 30% or less was judged as G2 (Good No2), and a case where the red rust area ratio was 20% or less was judged as G1 (Good No1).

Further, the head top part in a size of 20×20 mm was also cut out in a similar manner, the cross section of the Al—Fe-based plated layer was subjected to nital etching in a manner as described above, and the cross section of the Al—Fe-based plated layer was observed in a field of view of 100 μm×100 μm by using an optical microscope, to thereby measure the plating thickness and the thickness of the Al solid-dissolved Fe layer. At the same time, the configuration of the plated layer was observed, and the number per unit length of cracks reaching the Al solid-dissolved Fe layer in the Al—Fe-based plated layer was measured.

The results of measurement are listed in Table 2.

A case where the number of cracks reaching the Al solid-dissolved Fe layer per 100 μm was greater than 5 was judged as NG (No Good), a case where the number of cracks was greater than 2 and 5 or less was judged as G3 (Good No3), a case where the number of cracks was 2 or less was judged as G2 (Good No2), and a case where the number of cracks was 1 or less was judged as G1 (Good No1).

Levels are listed in Table 2 with invention examples of the present application (hereinafter, simply described as "invention examples") indicated as B1 to B16 and comparative examples indicated as b1 to b7.

TABLE 2

| | | OVERLAPPED BLANK | | | | | | | | | | |
|---|---|---|---|---|---|---|---|---|---|---|---|---|
| | | FIRST STEEL SHEET | | | SECOND STEEL SHEET | | | | | | | OVERLAPPED PART |
| | No. | SAMPLE MATERIAL | SHEET THICKNESS t1 (mm) | AREA S1 ($cm^2$) | SAMPLE MATERIAL | DIFFERENCE IN C CONTENT C2 − C1 (mass %) | SHEET THICKNESS t2 (mm) | SIZE LONG SIDE × SHORT SIDE ($mm^2$) | | AREA S2 ($cm^2$) | EXPRESSION (3) (S1 − S2) × (t1/10) ($cm^3$) | TOTAL SHEET THICKNESS (t1 + t2) (mm) |
| INVENTION EXAMPLE | B1 | A | 2.0 | 3600 | A | 0.00 | 2.0 | 173 | 100 | 173 | 685 | 4.0 |
| | B2 | A | 2.0 | 3600 | A | 0.00 | 2.0 | 490 | 100 | 490 | 622 | 4.0 |
| | B3 | A | 2.0 | 3600 | A | 0.00 | 2.0 | 794 | 100 | 794 | 561 | 4.0 |
| | B4 | A | 1.6 | 3600 | A | 0.00 | 2.0 | 794 | 100 | 794 | 449 | 3.6 |
| | B5 | A | 2.6 | 3600 | A | 0.00 | 2.0 | 173 | 100 | 173 | 891 | 4.6 |
| | B6 | A | 2.0 | 3600 | A | 0.00 | 3.0 | 490 | 100 | 490 | 622 | 5.0 |
| | B7 | A | 2.0 | 3600 | A | 0.00 | 3.0 | 490 | 100 | 490 | 622 | 5.0 |
| | B8 | A | 1.5 | 3600 | A | 0.00 | 1.5 | 490 | 100 | 490 | 467 | 3.0 |
| | B9 | A | 2.0 | 3600 | A | 0.00 | 1.5 | 490 | 100 | 490 | 622 | 3.5 |
| | B10 | B | 2.0 | 3600 | B | 0.00 | 2.0 | 490 | 100 | 490 | 622 | 4.0 |
| | B11 | B | 2.0 | 3600 | B | 0.00 | 2.0 | 490 | 100 | 490 | 622 | 4.0 |
| | B12 | A | 2.0 | 3600 | B | 0.00 | 2.0 | 490 | 100 | 490 | 622 | 4.0 |
| | B13 | A | 2.0 | 3600 | B | 0.00 | 2.0 | 490 | 100 | 490 | 622 | 4.0 |
| | B14 | A | 2.0 | 3600 | C | 0.14 | 2.0 | 173 | 100 | 173 | 685 | 4.0 |
| | B15 | A | 2.0 | 3600 | D | 0.06 | 2.0 | 173 | 100 | 173 | 685 | 4.0 |
| | B16 | A | 2.0 | 3600 | E | 0.24 | 2.0 | 173 | 100 | 173 | 685 | 4.0 |
| COMPARATIVE EXAMPLE | b1 | A | 1.0 | 3600 | A | 0.00 | 1.0 | 40 | 30 | 12 | 359 | 2.0 |
| | b2 | A | 4.0 | 3600 | A | 0.00 | 4.0 | 1196 | 100 | 1196 | 962 | 8.0 |
| | b3 | A | 2.0 | 3600 | A | 0.00 | 2.0 | 490 | 100 | 490 | 622 | 4.0 |
| | b4 | A | 2.0 | 3600 | A | 0.00 | 4.0 | 490 | 100 | 490 | 622 | 6.0 |
| | b5 | A | 2.0 | 3600 | A | 0.00 | 2.0 | 490 | 100 | 490 | 622 | 4.0 |
| | b6 | A | 2.0 | 3600 | A | 0.00 | 2.0 | 490 | 100 | 490 | 622 | 4.0 |
| | b7 | A | 4.0 | 3600 | A | 0.00 | 1.0 | 490 | 100 | 490 | 1244 | 5.0 |

TABLE 2-continued

| | | | OVERLAPPED BLANK HEATING STEP | | | | | PROPERTY EVALUATION OF OVERLAPPED MOLDED BODY | | |
|---|---|---|---|---|---|---|---|---|---|---|
| | | | AVERAGE HEATING RATE | | | | | | | |
| | No. | OVERLAPPED BLANK OVERLAPPED PART MAXIMUM LENGTH L (mm) | OVERLAPPED PORTION V (° C./s) | FIRST STEEL SHEET AT NON-OVERLAPPED PORTION v1 (° C./s) | DIFFERENCE IN AVERAGE HEATING RATE (v1 − V) (° C./s) | HEATING TEMPERATURE (° C.) | HEATING TIME (minute) | NUMBER OF CRACK (NUMBER/100 μm) | DIFFERENCE IN THICKNESS OF Al SOLID-DISSOLVED Fe LAYER (D1 − D2) (μm) | CORROSION RESISTANCE |
| INVENTION EXAMPLE | B1 | 200 | 2.5 | 5.0 | 2.5 | 900 | 8 | G2 | 4.0 | G2 |
| | B2 | 500 | 2.5 | 5.0 | 2.5 | 900 | 8 | G1 | 4.0 | G1 |
| | B3 | 800 | 2.5 | 5.0 | 2.5 | 900 | 8 | G1 | 4.0 | G1 |
| | B4 | 800 | 3.3 | 6.2 | 2.9 | 900 | 13 | G1 | 4.0 | G1 |
| | B5 | 800 | 2.5 | 5.0 | 2.5 | 900 | 13 | G1 | 4.0 | G1 |
| | B6 | 500 | 1.5 | 4.3 | 2.8 | 870 | 18 | G1 | 3.0 | G1 |
| | B7 | 500 | 2.0 | 5.0 | 3.0 | 900 | 8 | G1 | 4.0 | G1 |
| | B8 | 500 | 4.0 | 6.5 | 2.5 | 900 | 8 | G1 | 4.0 | G1 |
| | B9 | 500 | 3.5 | 5.0 | 1.5 | 900 | 8 | G1 | 4.0 | G1 |
| | B10 | 500 | 2.8 | 5.5 | 2.7 | 920 | 5 | G3 | 5.0 | G3 |
| | B11 | 500 | 2.8 | 5.5 | 2.7 | 920 | 11 | G3 | 5.0 | G3 |
| | B12 | 500 | 2.3 | 4.5 | 2.2 | 880 | 8 | G1 | 3.0 | G1 |
| | B13 | 500 | 2.3 | 4.5 | 2.5 | 880 | 16 | G1 | 3.0 | G1 |
| | B14 | 200 | 2.5 | 5.0 | 2.5 | 900 | 8 | G1 | 4.0 | G1 |
| | B15 | 200 | 2.5 | 5.0 | 2.5 | 900 | 8 | G1 | 4.0 | G1 |
| | B16 | 200 | 2.5 | 5.0 | 2.5 | 900 | 8 | G1 | 4.0 | G1 |
| COMPARATIVE EXAMPLE | b1 | 50 | 5.0 | 10.0 | 5.0 | 900 | 8 | NG | 4.0 | NG |
| | b2 | 1200 | 0.4 | 2.5 | 2.1 | 900 | 8 | NG | 2.0 | NG |
| | b3 | 500 | 2.5 | 5.0 | 2.5 | 900 | 3 | NG | 1.0 | NG |
| | b4 | 500 | 0.8 | 5.0 | 4.2 | 900 | 21 | NG | 0.5 | NG |
| | b5 | 500 | 2.0 | 4.0 | 2.0 | 850 | 10 | NG | 0.5 | NG |
| | b6 | 500 | 3.0 | 6.0 | 3.0 | 950 | 5 | NG | 7.0 | NG |
| | b7 | 500 | 2.0 | 2.5 | 0.5 | 900 | 8 | G2 | 0.5 | NG |

In Table 2, B1 to B16 being the invention examples of the present application exhibited good corrosion resistance, and the corrosion resistance of b1 to b7 being the comparative examples was NG.

Preferred embodiments of the present invention have been described above with reference to the accompanying drawings, but the present invention is not limited to the embodiments. It should be understood that various changes and modifications are readily apparent to those skilled in the art within the scope of the technical spirit as set forth in claims, and those should also be covered by the technical scope of the present invention.

EXPLANATION OF CODES

1 first steel sheet
1*a* face in contact with second steel sheet of first steel sheet
1*b* face not in contact with second steel sheet of first steel sheet
2 second steel sheet
2*a* face in contact with first steel sheet of second steel sheet
2*b* face not in contact with first steel sheet of second steel sheet
3 bonded part
4 overlapped blank for hot stamping
4*a* overlapped part of overlapped blank for hot stamping
4*b* one-sheet part of overlapped blank for hot stamping
5 heating furnace for hot stamping
6 press die for hot stamping
7 head top part
8 bent part on head top part side
9 bent part on flange side
10 vertical wall part
11 flange part
12 overlapped hot stamp molded body
13 surface on one side of Al-based plated steel sheet
14 Al-based plated layer
15 base material

What is claimed is:

1. A method of manufacturing an overlapped hot stamp molded body by using an overlapped blank obtained by overlapping and bonding a first steel sheet having an area S1 ($cm^2$) and at least one second steel sheet having an area smaller than that of the first steel sheet, wherein each of the first steel sheet and the second steel sheet is an Al-based plated steel sheet having an Al-based plated layer on a base material, the method of manufacturing an overlapped hot stamp molded body comprising:

heating the overlapped blank in a heating furnace;

carrying the heated overlapped blank out of the heating furnace and transferring it to a pressing apparatus; and performing presswork on the heated overlapped blank by using a die provided to the pressing apparatus, to obtain an overlapped hot stamp molded body, wherein:

in the heating furnace, when a sheet thickness of the first steel sheet is set to t1 (mm), a sheet thickness of the second steel sheet is set to t2 (mm), an average heating rate at a sheet temperature from 20° C. to 800° C. of a portion with a total sheet thickness (t1+t2) at which the first steel sheet and the second steel sheet are overlapped is set to V (° C./s), and an average heating rate at a sheet temperature from 20° C. to 800° C. of a portion, of the first steel sheet, which is not overlapped with the second steel sheet is set to v1 (C/s), the total sheet thickness (t1+t2) of the overlapped portion is 2.5 mm or more and 5.0 mm or less;

a maximum length L of the overlapped portion of the second steel sheet is 100 mm or more and 1100 mm or less;

the average heating rates V and v1 satisfy relational expressions of following Expression (1) and Expression (2);

when, out of an area of the second steel sheet, an area of a portion overlapped with the first steel sheet is set to S2 ($cm^2$), the areas S1 and S2, and the sheet thickness t1 satisfy a relational expression of following Expression (3); and the overlapped blank is heated at a heating temperature and for a heating time positioned within a figure ABCD defined by a point A (4 minutes, 930° C.), a point B (10 minutes, 930° C.), a point C (20 minutes, 870° C.), and a point D (8 minutes, 870° C.) on a plane of coordinates defined by the heating time and the heating temperature, $$1.0 \leq V \leq 4.0 \quad \text{Expression (1)}$$

$$(v1-V) \leq 3.0 \quad \text{Expression (2)}$$

$$400 \leq (S1-S2) \times (t1/10) \leq 950 \quad \text{Expression (3).}$$

2. The method of manufacturing an overlapped hot stamp molded body according to claim 1, wherein the maximum length L of the overlapped portion of the second steel sheet is 300 mm or more.

3. The method of manufacturing an overlapped hot stamp molded body according to claim 1, wherein the base material of the first steel sheet and the second steel sheet contains, by mass %, C: 0.10% or more and 0.50% or less, Si: 0.01% or more and 2.00% or less, Mn: 0.30% or more and 5.00% or less, P: 0.100% or less, S: 0.1000% or less, N: 0.0100% or less, Al: 0.500% or less, and B: 0.0002% or more and 0.0100% or less, with the balance made up of Fe and impurities.

4. The method of manufacturing an overlapped hot stamp molded body according to claim 3, wherein the base material of the first steel sheet and the second steel sheet further contains, by mass %, as a substitute for a part of Fe being the balance, one or more kinds of W: 0% or more and 3.0% or less, Cr: 0% or more and 2.0% or less, Mo: 0% or more and 3.0% or less, V: 0% or more and 2.0% or less, Ti: 0% or more and 0.5% or less, Nb: 0% or more and 1.0% or less, Ni: 0% or more and 5.0% or less, Cu: 0% or more and 3.0% or less, Co: 0% or more and 3.0% or less, Sn: 0% or more and 0.10% or less, Sb: 0% or more and 0.10% or less, Mg: 0% or more and 0.0050% or less, Ca: 0% or more and 0.0050% or less, O: 0% or more and 0.0070% or less, and REM: 0% or more and 0.0070% or less.

5. The method of manufacturing an overlapped hot stamp molded body according to claim 3, wherein a C content C1 (mass %) of the base material of the first steel sheet and a C content C2 (mass %) of the base material of the second steel sheet satisfy a relational expression of following Expression (4), $$0.03 \leq (C2-C1) \leq 0.30 \quad \text{Expression (4).}$$

6. An overlapped hot stamp molded body comprising: a first steel sheet having an area S1 ($cm^2$); and at least one second steel sheet having an area smaller than that of the first steel sheet, the first steel sheet and the second steel sheet being stacked on each other, wherein:

an Al—Fe-based plated layer is provided on surfaces of the first steel sheet and the second steel sheet;

the Al—Fe-based plated layer is formed of a compound layer of Al and Fe, and an Al solid-dissolved Fe layer;

when a sheet thickness of the first steel sheet and a sheet thickness of the second steel sheet are set to t1 and t2 (mm), respectively, a total sheet thickness (t1+t2) of a portion at which the first steel sheet and the second steel sheet are overlapped is 2.5 mm or more and 5.0 mm or less;

a maximum length L of the overlapped portion of the second steel sheet is 100 mm or more and 1100 mm or less;

when, out of an area of the second steel sheet, an area of a portion overlapped with the first steel sheet is set to S2 ($cm^2$), the areas S1 and S2, and the sheet thickness t1 satisfy a relational expression of following Expression (3);

in the Al—Fe-based plated layer of the portion at which the first steel sheet and the second steel sheet are overlapped, on a face at which the first steel sheet is not in contact with the second steel sheet, the number of cracks reaching the Al solid-dissolved Fe layer is 5 or less per length of 100 μm parallel to the Al—Fe-based plated layer; and a thickness D1 (μm) of the Al solid-dissolved Fe layer of a portion, of the first steel sheet, which is not overlapped with the second steel sheet and a thickness D2 (μm) of the Al solid-dissolved Fe layer of the second steel sheet satisfy a relational expression of following Expression (5), $$400 \leq (S1-S2) \times (t1/10) \leq 950 \quad \text{Expression (3)}$$

$$(D1-D2) \leq 6.0 \quad \text{Expression (5).}$$

7. The overlapped hot stamp molded body according to claim 6, wherein the maximum length L of the overlapped portion of the second steel sheet is 300 mm or more.

8. The overlapped hot stamp molded body according to claim 6, wherein the base material of the first steel sheet and the second steel sheet contains, by mass %, C: 0.10% or more and 0.50% or less, Si: 0.01% or more and 2.00% or less, Mn: 0.30% or more and 5.00% or less, P: 0.100% or less, S: 0.1000% or less, N: 0.0100% or less, Al: 0.500% or less, and B: 0.0002% or more and 0.0100% or less, with the balance made up of Fe and impurities.

9. The overlapped hot stamp molded body according to claim 8, wherein the base material of the first steel sheet and the second steel sheet further contains, by mass %, as a substitute for a part of Fe being the balance, one or more kinds of W: 0% or more and 3.0% or less, Cr: 0% or more and 2.0% or less, Mo: 0% or more and 3.0% or less, V: 0% or more and 2.0% or less, Ti: 0% or more and 0.5% or less, Nb: 0% or more and 1.0% or less, Ni: 0% or more and 5.0% or less, Cu: 0% or more and 3.0% or less, Co: 0% or more and 3.0% or less, Sn: 0% or more and 0.10% or less, Sb: 0% or more and 0.10% or less, Mg: 0% or more and 0.0050% or less, Ca: 0% or more and 0.0050% or less, O: 0% or more and 0.0070% or less, and REM: 0% or more and 0.0070% or less.

10. The overlapped hot stamp molded body according to claim 8, wherein a C content C1 (mass %) of the base material of the first steel sheet and a C content C2 (mass %) of the base material of the second steel sheet satisfy a relational expression of following Expression (4), $$0.3 \leq (C2 - C1) \leq 0.30 \quad \text{Expression (4).}$$

* * * * *